US008430716B2

(12) United States Patent
Fukushima et al.

(10) Patent No.: US 8,430,716 B2
(45) Date of Patent: Apr. 30, 2013

(54) POLISHING METHOD AND POLISHING APPARATUS

(75) Inventors: Makoto Fukushima, Tokyo (JP); Tetsuji Togawa, Tokyo (JP); Hozumi Yasuda, Tokyo (JP); Osamu Nabeya, Tokyo (JP); Shingo Saito, Tokyo (JP)

(73) Assignee: Ebara Corporation, Tokyo (JP)

( * ) Notice: Subject to any disclaimer, the term of this patent is extended or adjusted under 35 U.S.C. 154(b) by 1041 days.

(21) Appl. No.: 12/320,471

(22) Filed: Jan. 27, 2009

(65) Prior Publication Data

US 2009/0191791 A1 Jul. 30, 2009

(30) Foreign Application Priority Data

Jan. 30, 2008 (JP) ..... 2008-019754

(51) Int. Cl.
*B24B 7/22* (2006.01)

(52) U.S. Cl.
USPC ..... 451/8; 451/41

(58) Field of Classification Search ..... 451/41, 451/287, 288, 289, 5, 8
See application file for complete search history.

(56) References Cited

U.S. PATENT DOCUMENTS

| | | | | |
|---|---|---|---|---|
| 5,670,011 | A | 9/1997 | Togawa et al. | |
| 5,830,045 | A | 11/1998 | Togawa et al. | |
| 5,888,124 | A | 3/1999 | Lin et al. | |
| 5,893,794 | A | 4/1999 | Togawa et al. | |
| 5,934,984 | A | 8/1999 | Togawa et al. | |
| 5,957,751 | A | 9/1999 | Govzman et al. | |
| 6,050,884 | A | 4/2000 | Togawa et al. | |
| 6,086,454 | A | 7/2000 | Watanabe et al. | |
| 6,241,592 | B1 | 6/2001 | Togawa et al. | |
| 6,241,593 | B1 | 6/2001 | Chen et al. | |
| 6,283,822 | B1 | 9/2001 | Togawa et al. | |
| 6,332,826 | B1 | 12/2001 | Katsuoka et al. | |
| 6,343,973 | B1 | 2/2002 | Somekh | |
| 6,358,131 | B1 | 3/2002 | Sakurai et al. | |
| 6,409,582 | B1 | 6/2002 | Togawa et al. | |
| 6,413,146 | B1 | 7/2002 | Katsuoka et al. | |
| 6,431,968 | B1 | 8/2002 | Chen et al. | |
| 6,514,124 | B1 * | 2/2003 | Zuniga et al. | 451/41 |
| 6,561,884 | B1 | 5/2003 | White et al. | |
| 6,578,891 | B1 | 6/2003 | Suzuki et al. | |
| 6,595,220 | B2 | 7/2003 | Maekawa et al. | |

(Continued)

FOREIGN PATENT DOCUMENTS

| | | |
|---|---|---|
| JP | 08-300253 | 11/1996 |
| JP | 11-188620 | 7/1999 |

(Continued)

*Primary Examiner* — Robert Rose
(74) *Attorney, Agent, or Firm* — Wenderoth, Lind & Ponack, L.L.P.

(57) ABSTRACT

A polishing method can safely detach and lift up a workpiece from a polishing surface without carrying out the operation of making the workpiece overhang the polishing surface. The polishing method includes carrying out processing of a surface to be polished of a workpiece by supplying a liquid to a polishing surface while pressing the surface to be polished of the workpiece held by a holding device against the polishing surface and moving the workpiece and the polishing surface relative to each other, attracting the workpiece after the processing to the holding device while supplying the liquid to the polishing surface at a decreased flow rate, thereby detaching the workpiece from the polishing surface, and lifting up the holding device together with the workpiece on confirmation of detachment of the workpiece from the polishing surface and attachment of the workpiece to the holding device.

10 Claims, 20 Drawing Sheets

U.S. PATENT DOCUMENTS

| | | | | |
|---|---|---|---|---|
| 6,629,883 | B2 | 10/2003 | Katsuoka et al. | |
| 6,663,469 | B2 | 12/2003 | Kimura et al. | |
| 6,746,312 | B2 | 6/2004 | Torii et al. | |
| 6,852,019 | B2 | 2/2005 | Togawa et al. | |
| 6,857,931 | B2 | 2/2005 | Chen et al. | |
| 6,878,044 | B2 | 4/2005 | Sakurai et al. | |
| 6,905,392 | B2 * | 6/2005 | Bottema et al. | 451/5 |
| 7,008,303 | B2 | 3/2006 | White et al. | |
| 7,083,507 | B2 | 8/2006 | Togawa et al. | |
| 7,101,255 | B2 | 9/2006 | Katsuoka et al. | |
| 7,108,592 | B2 | 9/2006 | Fukaya et al. | |
| 7,156,725 | B2 | 1/2007 | Togawa et al. | |
| 7,163,895 | B2 | 1/2007 | Togawa et al. | |
| 7,175,504 | B2 | 2/2007 | Izumi et al. | |
| 2004/0121704 | A1 | 6/2004 | Sakurai et al. | |
| 2004/0198011 | A1 | 10/2004 | Togawa et al. | |
| 2007/0264914 | A1 | 11/2007 | Isobe et al. | |

FOREIGN PATENT DOCUMENTS

| | | |
|---|---|---|
| JP | 11-347922 | 12/1999 |
| JP | 2001-096455 | 4/2001 |
| JP | 2001-156031 | 6/2001 |
| JP | 2002-184732 | 6/2002 |
| JP | 2002-217147 | 8/2002 |
| JP | 2003-053661 | 2/2003 |
| JP | 2003-103458 | 4/2003 |
| JP | 2003-109926 | 4/2003 |
| JP | 2003-311609 | 11/2003 |
| JP | 2004-006559 | 1/2004 |
| JP | 2004-106118 | 4/2004 |
| JP | 2004-193289 | 7/2004 |
| JP | 2004-195629 | 7/2004 |
| JP | 2004-345018 | 12/2004 |
| JP | 2005-101633 | 4/2005 |
| JP | 2005-123485 | 5/2005 |
| JP | 2005-131732 | 5/2005 |
| JP | 2006-035328 | 2/2006 |
| JP | 2006-303249 | 11/2006 |
| JP | 2007-189258 | 7/2007 |
| JP | 2007-287993 | 11/2007 |
| WO | 2004/094105 | 11/2004 |

* cited by examiner

POLISHING METHOD AND POLISHING APPARATUS

BACKGROUND OF THE INVENTION

1. Field of the Invention

The present invention relates to a polishing apparatus and a polishing method, and more particularly to a polishing apparatus and a polishing method for polishing and flattening a workpiece or substrate, such as a semiconductor wafer.

2. Description of the Related Art

With the recent progress toward higher integration of semiconductor devices, circuit interconnects are becoming finer and the distance between adjacent interconnects is becoming smaller. Especially when forming a circuit pattern by optical lithography with a line width of not more than 0.5 μm, a stepper requires a high flatness of imaging surface because of the small depth of focus. A polishing apparatus for carrying out chemical mechanical polishing or CMP, is known as a means for flattening a surface of such a semiconductor wafer.

As shown in FIG. 1, conventionally, a polishing apparatus comprises a turntable 504 having, on its upper surface, a polishing pad 502 having a polishing surface 500, a top ring 506 as a holding device for holding, on its lower surface, a semiconductor wafer W as a workpiece, and a liquid supply nozzle 508 as a liquid supply device for supplying a liquid Q, such as a slurry or a dressing liquid, to the polishing surface 500. When polishing a semiconductor wafer W by such a polishing apparatus, the semiconductor wafer W, which is held on the lower surface of the top ring 506, i.e., a holding device or a polishing head, is pressed against the polishing surface 500 at a predetermined pressure while supplying a slurry from the liquid supply nozzle 508 to the polishing surface 500 and moving the turntable 504 and the top ring 506 relative to each other. The semiconductor wafer W is thus kept rubbed with the polishing surface 500 in the presence of the slurry, whereby the surface of the semiconductor wafer W is polished into a flat mirror surface.

After completion of the polishing of the surface of the semiconductor wafer W, a so-called lift-off operation, which involves again attracting the semiconductor wafer W to the top ring 500, and lifting up the top ring 506 to detach and lift the semiconductor wafer W from the polishing surface 500 of the polishing pad 502, is carried out. At the start of the lift-off operation, a liquid Q, such as the slurry, a cleaning liquid or pure water, is present between the polishing pad 502 and the semiconductor wafer W. Due to the presence of the liquid Q, an attraction force is produced between the polishing pad 502 and the semiconductor wafer W. Therefore, in order to detach the semiconductor wafer W from the polishing surface 500 upon the lift-off operation, it is necessary to lift up the semiconductor wafer W with a force that counteracts the attraction force.

It is therefore a common practice to laterally move the top ring 506 holding the semiconductor wafer W and make the semiconductor wafer W overhang the turntable 504 by about ⅓ of the diameter so as to reduce the attraction force between the semiconductor wafer W and the polishing pad 502, as shown in FIG. 2, and then lift up the top ring 506 to detach the semiconductor wafer W from the polishing surface 500. A stable lift-off operation becomes possible by thus making the semiconductor wafer W overhang the polishing pad 502 and thereby reducing the attraction force between them. However, in such a lift-off operation which involves overhanging of the semiconductor wafer W, contact of an edge of the polishing pad 502 with the semiconductor wafer W can scratch the surface of the semiconductor wafer W.

On the other hand, when lifting a semiconductor wafer off a polishing pad after polishing without overhanging of the semiconductor wafer, there are cases where because of the strong attraction force acting between the polishing pad and the semiconductor wafer, the semiconductor wafer cannot be picked up, or the semiconductor wafer breaks due to a heavy load applied on it.

SUMMARY OF THE INVENTION

In order to lift a semiconductor wafer after polishing off a polishing pad without overhanging of the semiconductor wafer, it is necessary to supply a gas or make an enough space between the polishing pad and the semiconductor wafer upon lift-off of the semiconductor wafer to thereby break the negative pressure between the polishing pad and the semiconductor wafer. In some cases, polishing pads having holes or grooves for passage of air can be used, and in some cases polishing pads not having such holes or grooves can be used. When a polishing pad having no groove in a surface is used, lift-off of a semiconductor wafer is more difficult than when a polishing pad having a groove in a surface is used because the polishing pad having no groove has no passage for air. Even when a polishing pad having a groove(s) in a surface is used, the groove becomes shallower as the polishing pad wears down, whereby lift-off of a semiconductor wafer becomes difficult.

An amount of an attraction force produced between a polishing pad or a polishing surface of a turntable, and a semiconductor wafer upon lift-off of the semiconductor wafer can be considered to be related to a thickness of a liquid film, or a liquid whose depth of is thin as if a film, which is present between the polishing pad and the semiconductor wafer at the start of lift-off operation, when the wafer is attracted to a top ring. That is, the thinner the liquid film, the less the semiconductor wafer deforms and the less is the attraction force between the semiconductor wafer and the polishing pad. Accordingly, it is easier to lift the semiconductor wafer off the polishing pad. Conversely, the thicker the liquid film, the more the semiconductor wafer deforms and the more is the attraction force between the semiconductor wafer and the polishing pad. Accordingly, it is harder to lift the semiconductor wafer off the polishing pad.

When a turntable or a rotatable table, having a polishing surface thereon, is rotating at a high speed before the operation of attracting and attaching a semiconductor wafer to a top ring is started, for example, a so-called hydroplaning phenomenon may occur in which a thickness of a liquid film between the semiconductor wafer and a polishing pad becomes thick. If the semiconductor wafer attraction operation is started during such a hydroplaning phenomenon, the semiconductor wafer will deform into a sucker-like shape as it begins to be lifted up. The fact that a semiconductor wafer most easily deforms in the edge portion is considered to be a cause for the sucker-like deformation of the semiconductor wafer. The larger the sucker-like deformation of the semiconductor wafer, the larger the attraction force between the semiconductor wafer and the polishing pad. If the semiconductor wafer is drawn up by a force which is larger than the attraction force, then the semiconductor wafer can be detached from the polishing pad. Alternatively, if a gas, such as air, enters the gap between the semiconductor wafer and the polishing pad, the sucker-like deformation of the semiconductor wafer will disappear and the semiconductor wafer can be easily detached from the polishing pad.

When the rotational speed of the turntable is high, the initial gap, i.e., a thickness of liquid film, between the semiconductor wafer and the polishing pad is large due to the hydroplaning phenomenon. Accordingly, when the semiconductor wafer begins to be detached from the polishing pad, the semiconductor wafer deforms largely into a sucker-like shape, creating a strong negative pressure between the polishing pad and the semiconductor wafer. If the polishing pad is a perforated pad having recesses or holes in a surface and having no groove extending across the semiconductor wafer, fresh air will be kept supplied, though in a very small amount, through the recesses or holes to between the polishing pad and the semiconductor wafer, whereby the negative pressure will gradually decrease. However, a fluid will also be kept supplied concomitantly with air. This makes time taken for removing the negative pressure uncertain.

When a pressurized fluid in a soft rubber air bag provided in a top ring, i.e., a carrier head (or a polishing head) is utilized to press a semiconductor wafer against a polishing pad, the gap between a lower surface of the top ring and a polishing surface of the polishing pad is wider than a thickness of the semiconductor wafer and is usually controlled within the range of about 1 mm to 3 mm. The gap is necessary for the pressurized fluid to be present over an entire area of the semiconductor wafer. Therefore, when lifting the semiconductor wafer off the polishing pad without overhanging of the semiconductor wafer, the lift-off operation is usually carried out in two steps: attachment of the semiconductor wafer to the top ring; and lifting of the top ring. While time for attachment of the semiconductor wafer is usually set at several seconds, there is a case where the attraction pressure between the polishing pad and the semiconductor wafer does not decrease during the several-second wafer attachment step to such a degree that the semiconductor wafer can be detached from the polishing pad. In this case, it is necessary to employ a stronger force to detach the semiconductor wafer from the polishing pad, or to lengthen time to attach the semiconductor wafer to the top ring.

The present invention has been made in view of the above situation in the related art. It is therefore an object of the present invention to provide a polishing method and a polishing apparatus which can safely detach and lift up a workpiece, such as a semiconductor wafer, from a polishing surface without carrying out the operation of making the workpiece overhang the polishing surface.

In order to achieve the above object, the present invention provides a polishing method comprising: carrying out processing of a surface to be polished of the workpiece by supplying a liquid at a first flow rate to a polishing surface of a turntable and pressing the surface to be polished of the workpiece held by a holding device against the polishing surface while moving the workpiece and the polishing surface relative to each other; attracting the workpiece after the processing to the holding device while supplying the liquid to the polishing surface at a second flow rate that is lower than the first flow rate and decreasing with passing the time, thereby detaching the workpiece from the polishing surface; confirming detachment of the workpiece from the polishing surface and attachment of the workpiece to the holding device; and lifting up the holding device together with the workpiece after confirming detachment of the workpiece from the polishing surface and attachment of the workpiece to the holding device.

When a holding device, such as a top ring, attracts a workpiece, such as a semiconductor wafer, so as to detach the workpiece from a polishing surface in a lift-off operation for the workpiece after processing, the polishing surface and the workpiece (semiconductor wafer) are spaced apart from each other with a small gap formed therebetween. A liquid supplied to the polishing surface flows though the gap, obstructing detachment of the workpiece from the polishing surface. Therefore, by decreasing an amount of the liquid to be supplied when an attraction force of the holding device (top ring) begins to act on the workpiece, it becomes possible to allow air to enter the gap between the workpiece and the polishing surface, thereby reducing an attraction force that attracts the workpiece to the polishing surface, i.e., a negative pressure produced between the workpiece and the polishing surface. The liquid to be supplied may be a slurry, pure water, a cleaning solution, a liquid chemical, and so forth. Pure water, for example, is supplied to the polishing surface in order to prevent the workpiece after polishing, such as a semiconductor wafer, from being scratched by contact with the polishing surface.

The polishing surface is in contact with and moves relative to a retainer ring, which is generally provided in the holding device such as a top ring, even during the operation of attracting the workpiece, such as a semiconductor wafer, to the holding device. It is therefore preferred that the amount of the liquid supplied be decreased at most to such an amount as not to dry out the polishing surface and the retainer ring.

Upon the start of the workpiece lift-off operation, i.e., when attracting the workpiece after the processing to the holding device to detach the workpiece from the polishing surface, the flow rate of the liquid to be supplied to the polishing surface may be stepwise decreased to zero.

This can decrease the amount of the liquid which serves to deform the workpiece into a sucker-like shape and securely eliminate the sucker-like deformation of the workpiece.

The present invention provides another polishing method comprising: carrying out processing of a surface to be polished of a workpiece by supplying a liquid to a polishing surface of a turntable and pressing the surface to be polished of the workpiece held by a holding device against the polishing surface while moving the workpiece and the polishing surface relative to each other; attracting the workpiece after the processing to the holding device while intermittently supplying the liquid to the polishing surface, thereby detaching the workpiece from the polishing surface; confirming detachment of the workpiece from the polishing surface and attachment of the workpiece to the holding device; and lifting up the holding device together with the workpiece on confirmation of detachment of the workpiece from the polishing surface and attachment of the workpiece to the holding device. The intermittent supply of the liquid may be performed by opening and closing a valve provided in a supply line for the liquid, or by using a flow controller for the liquid.

The amount of the liquid to be supplied to the polishing surface can be decreased to such an amount as to allow air to enter the gap between the workpiece and the polishing surface also by intermittently supplying the liquid to the polishing surface, i.e., repeating supply of the liquid and stop of the supply at certain intervals when attracting the workpiece to the holding device to detach the workpiece from the polishing surface in the lift-off operation for the workpiece.

The present invention provides yet another polishing method comprising: carrying out processing of a surface to be polished of a workpiece by supplying a liquid to a polishing surface of a turntable and pressing the surface to be polished of the workpiece held by a holding device against the polishing surface while moving the workpiece and the polishing surface relative to each other at a first relative speed; attracting the workpiece after the processing to the holding device while moving the workpiece and the polishing surface at a second relative speed, which is lower than the first relative speed and decreasing the passing the time, thereby detaching the workpiece from the polishing surface; and lifting up the holding device together with the workpiece.

An experiment was conducted in which a semiconductor wafer (workpiece) was attracted to a top ring (holding device) while moving the semiconductor wafer and a polishing surface at varying relative speeds, and time taken for lift-off of the semiconductor wafer, etc. was measured. As a result, it was found that the sucker effect, which produces a negative pressure between a polishing surface and a semiconductor wafer, can be reduced by decreasing the relative speed between the polishing surface and the semiconductor wafer. Thus, by attracting the workpiece to a holding device while moving the workpiece and the polishing surface at a decreased relative speed in the lift-off operation, the workpiece can be detached easily and quickly from the polishing surface while reducing the deformation of the workpiece.

It has been confirmed experimentally that when attracting the workpiece after processing to the holding device to detach the workpiece from the polishing surface, it is preferred to decrease the rotational speed of the polishing surface to 30 rpm or lower, or to decrease the relative speed at the center point of the workpiece to 613 mm/sec or lower.

The present invention provides yet another polishing method comprising: carrying out processing of a surface to be polished of a workpiece by supplying a liquid to a polishing surface of a turntable and pressing the surface to be polished of the workpiece held by a holding device against the polishing surface while moving the workpiece and the polishing surface relative to each other; attracting the workpiece after the processing to the holding device while supplying a foaming liquid to the polishing surface, thereby detaching the workpiece from the polishing surface; confirming detachment of the workpiece from the polishing surface and attachment of the workpiece to the holding device; and lifting up the holding device together with the workpiece after confirming detachment of the workpiece from the polishing surface and attachment of the workpiece to the holding device.

The negative pressure produced between the workpiece and the polishing surface upon the lift-off operation can be decreased by allowing a foaming liquid, such as carbonated water, to be present between the workpiece and the polishing surface, and foaming the liquid present between the workpiece and the polishing surface.

The present invention provides yet another polishing method comprising: carrying out processing of a surface to be polished of a workpiece by supplying a liquid to a polishing surface of a turntable and pressing the surface to be polished of the workpiece held by a holding device against the polishing surface while moving the workpiece and the polishing surface relative to each other; attracting the workpiece after the processing to the holding device, thereby detaching the workpiece from the polishing surface; and lifting up the holding device together with the workpiece by a force which is smaller than a force that attracts the workpiece to the holding device.

Preferably, the degree of vacuum in the operation of attracting the workpiece is gradually increased until the workpiece detaches from the polishing surface.

The higher the pressure of attracting the workpiece, the larger is the force of detaching the workpiece from the polishing surface. The use of such a higher attraction pressure, however, causes a larger deformation of the workpiece and thus applies a larger stress to the workpiece. Also when the workpiece is attached by attraction to the holding device, the workpiece will deform by the attraction force, causing a stress in the workpiece. The two stresses acting on the workpiece can be minimized by controlling the degree of vacuum for attraction of the workpiece at a low level in such a manner that the degree of vacuum is gradually increased until the workpiece detaches from the polishing surface.

The present invention provides yet another polishing method comprising: carrying out processing of a surface to be polished of a workpiece by supplying a liquid to a polishing surface while pressing the surface to be polished of the workpiece held by a holding device against the polishing surface and moving the workpiece and the polishing surface relative to each other; attracting the workpiece after the processing to the holding device at a first vacuum pressure, thereby detaching the workpiece from the polishing surface; and switching the first vacuum pressure to a second vacuum pressure whose degree of vacuum is lower than the degree of vacuum of the first vacuum pressure but higher than that of the air pressure.

According to this method, after the workpiece detaches from the polishing surface, the holding device can attract and hold the workpiece at a vacuum pressure necessary to hold the workpiece. The first vacuum pressure for detaching the workpiece from the polishing surface and the second vacuum pressure for attaching the workpiece to the holding device, which differ in the degree of vacuum, can be switched by switching between two vacuum sources with a valve, or by using an automatic pressure regulator capable of switching of pressures by signals.

The vacuum pressures are fixedly operated if no means is provided for detecting the moment the workpiece detaches from the polishing pad. In general, the degree of vacuum for detachment of the workpiece from the polishing surface is set high, while the degree of vacuum for attachment of the workpiece to the holding device is set lower. The respective vacuum pressure values may be set in a manual vacuum pressure regulator and timely selected by a switching valve, such as a three-way valve.

The confirmation of detachment of the workpiece from the polishing surface and attachment of the workpiece to the holding device may be made based on a decrease in electric current in a motor that drives the polishing surface or in a motor that drives the holding device.

When the workpiece, which is not yet detached from and lies on the polishing surface, is moved relative to the polishing surface, a friction force is produced between them, whereby a load is applied on a motor that drives the polishing surface or the holding device. The load can be monitored as a motor current value. It is therefore possible to set a threshold value of motor current value and use it as a trigger for lifting of the holding device. The workpiece can be lifted up safely and securely by thus starting lifting of the holding device immediately after the workpiece has detached from the polishing surface and attached to the holding device.

In the lift-off operation for the workpiece, the confirmation of detachment of the workpiece from the polishing surface and attachment of the workpiece to the holding device may also be made by detecting a change in a thickness of a liquid film covering the polishing surface.

The distribution of the liquid supplied to the polishing surface differs between the presence and absence of the workpiece on the polishing surface. The liquid film lying downstream of the holding device (top ring) is thin in relative to the latter case when the workpiece is on the polishing surface, whereas the liquid film lying downstream of the holding device becomes thick in relative to the former case when the workpiece detaches from the polishing surface. Especially when the holding device has a retainer ring, having a groove in its surface to be in contact with the polishing surface, for holding the periphery of the workpiece, the liquid is supplied to the workpiece in a larger amount, which produces a larger difference in the thickness of the liquid film between the presence and absence of the workpiece on the polishing surface. The change in the thickness of the liquid film, which can be used as a trigger for lifting of the holding device, may be detected by using a sensor capable of detecting the thickness of the liquid film, such as a laser sensor, an ultrasonic sensor, a contact sensor or a capacitance sensor.

The confirmation of detachment of the workpiece from the polishing surface and attachment of the workpiece to the holding device may also be made based on a change in a force that draws the holding device downward upon detachment of the workpiece from the polishing surface. The force that draws the holding device downward can be detected, e.g., by a change in motor current value in a lifting shaft drive motor.

The confirmation of detachment of the workpiece from the polishing surface and attachment of the workpiece to the holding device may also be made by detecting a distance between the workpiece and the polishing surface. The distance between the workpiece and the polishing surface can be detected, e.g., with an eddy current sensor.

When the workpiece begins to be attracted to the holding device, that portion of the workpiece which corresponds to an attraction portion of the holding device becomes raised, while the other portion of the workpiece is drawn downward (i.e., in the opposite direction from the holding device) by the attraction force produced between the polishing surface and the workpiece. Thus, when an eddy current sensor is fixed under the polishing surface, that portion of the workpiece which corresponds to the attraction portion of the holding device, as it is attracted to the attraction portion, moves apart from the eddy current sensor whereby the electromagnetic field, encircling the eddy current sensor and that portion of the workpiece, step by step or gradually becomes weak and the signal value decreases. On the other hand, the edge portion of the workpiece, on which the attraction force (force that draws the workpiece downward) between the polishing surface and the workpiece strongly acts, little moves away from the polishing surface. Accordingly, the signal value little decreases. By utilizing the difference in the signal value, it becomes possible to determine (confirm) the distribution of vertical positions of the entire workpiece with respect to the polishing surface. Such data can be used as a trigger for lifting of the holding device. Furthermore, the deformation of the workpiece can also be determined. Therefore, when a deformation, which would apply a heavy load on the workpiece, is detected, the attraction on the workpiece can be stopped to prevent breakage of the workpiece.

Preferably, the workpiece is lifted up together with the holding device while stepwise changing the height of the holding device. It is also possible to stepwise change the force to lift up the holding device together with the workpiece.

In order to prevent failure to pick up the workpiece, the pressure between the holding device and the workpiece before the start of the holding device lifting operation in the lift-off operation is required to be a high vacuum of generally about −80±10 kPa. When lifting of the holding device is started while the workpiece is kept attached to the polishing surface, a force that detaches the workpiece from the polishing surface is produced. If the holding device is lifted at a high speed, the attraction force of the holding device on the workpiece can be broken, resulting in failure to pick up the workpiece. In view of this, the lifting of the workpiece may be carried out in a gradual manner or the lifting speed may be lowered, whereby the workpiece can be stably lifted off the polishing surface. Further, the workpiece can be lifted off securely by lifting the holding device in such a manner that the lifting force will not break the attraction of the holding device on the workpiece. For example, the workpiece can be lifted off securely by lifting the holding device while keeping the lifting force lower than the attraction force of the holding device on the workpiece.

The present invention also provides a polishing apparatus comprising a turntable having a polishing surface thereon, a vertically-movable holding device for detachably holding a workpiece and pressing the workpiece against the polishing surface, a liquid supply device for supplying a liquid to the polishing surface, a movement mechanism for moving the turntable having the polishing surface and the holding device relative to each other, and a control device for controlling an amount of the liquid to be supplied from the liquid supply device to the polishing surface. When attracting the workpiece, which has been processed by contact with the polishing surface in the presence of the liquid, to the holding device and detaching the workpiece from the polishing surface, the control device controls the liquid supply device to supply the liquid to the polishing surface at a decreased flow rate relative to the flow rate during polishing, intermittently supply the liquid to the polishing surface, or supply a foaming liquid to the polishing surface.

The present invention provides another polishing apparatus comprising a turntable having a polishing surface, a vertically-movable holding device for detachably holding a workpiece and pressing the workpiece against the polishing surface, a liquid supply device for supplying a liquid to the polishing surface, a movement mechanism for moving the turntable having the polishing surface and the holding device relative to each other, and a control device for controlling the movement mechanism. When attracting the workpiece, which has been processed by contact with the polishing surface in the presence of the liquid, to the holding device and detaching the workpiece from the polishing surface, the control device controls the movement mechanism to decrease the relative speed between the polishing surface of the turntable and the holding device.

The present invention provides yet another polishing apparatus comprising a turntable having a polishing surface, a vertically-movable holding device for detachably holding a workpiece and pressing the workpiece against the polishing surface, a liquid supply device for supplying a liquid to the polishing surface, a movement mechanism for moving the turntable having the polishing surface and the holding device relative to each other, and a film thickness detection sensor. The film thickness detection sensor detects a thickness of a liquid film covering the polishing surface in order to sense whether the workpiece, which has been processed by contact with the polishing surface in the presence of the liquid, has detached from the polishing surface.

The present invention provides yet another polishing apparatus comprising a turntable having a polishing surface, a vertically-movable holding device for detachably holding a workpiece and pressing the workpiece against the polishing surface, a liquid supply device for supplying a liquid to the polishing surface, a movement mechanism for moving the turntable having the polishing surface and the holding device relative to each other, and a distance measuring sensor. The distance measuring sensor detects the distance between the workpiece and the polishing surface in order to sense whether the workpiece, which has been processed by contact with the polishing surface in the presence of the liquid, has detached from the polishing surface.

The distance measuring sensor is, for example, an eddy current sensor.

The present invention makes it possible to decrease a negative pressure produced between a workpiece, such as a semiconductor wafer, and a polishing surface and safely detach and lift up the workpiece from the polishing surface without carrying out the operation of making the workpiece overhang the polishing surface.

DETAILED DESCRIPTION OF THE PREFERRED EMBODIMENTS

Preferred embodiments of the present invention will now be described with reference to the drawings. The following description illustrates the case of polishing a semiconductor wafer as a workpiece, held by a top ring as a holding device, by rubbing a surface (surface to be polished) of the semiconductor wafer or workpiece (substrate) with a polishing surface of a polishing pad disposed on the turntable.

Figure 1:
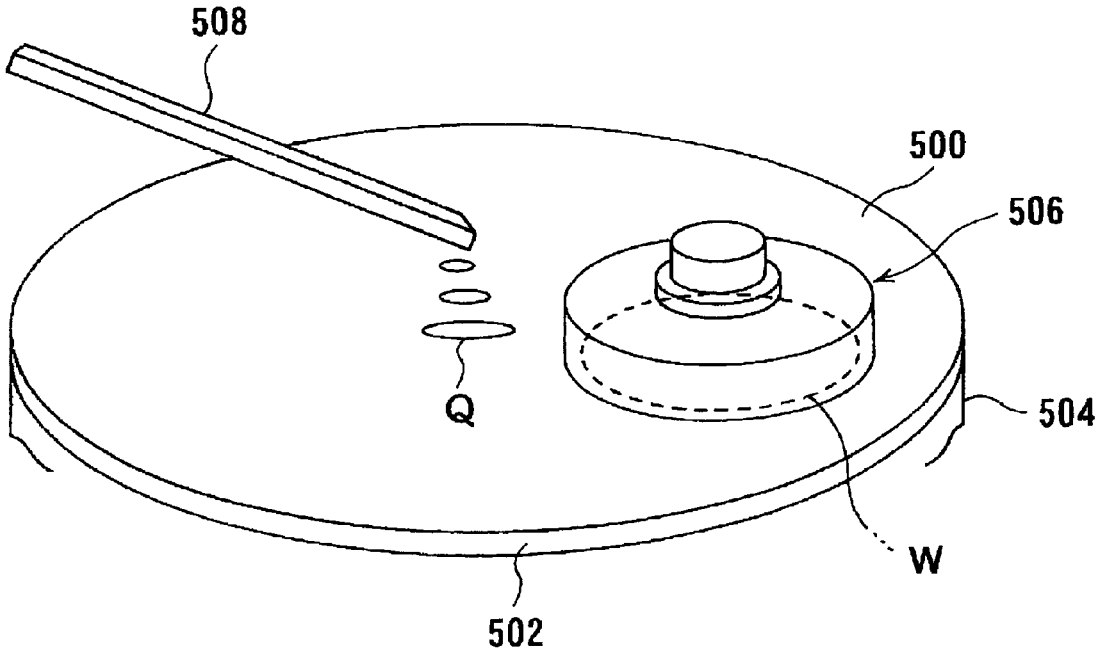
FIG. 1 is a schematic perspective view of the main portion of a conventional polishing apparatus.
Figure 2:
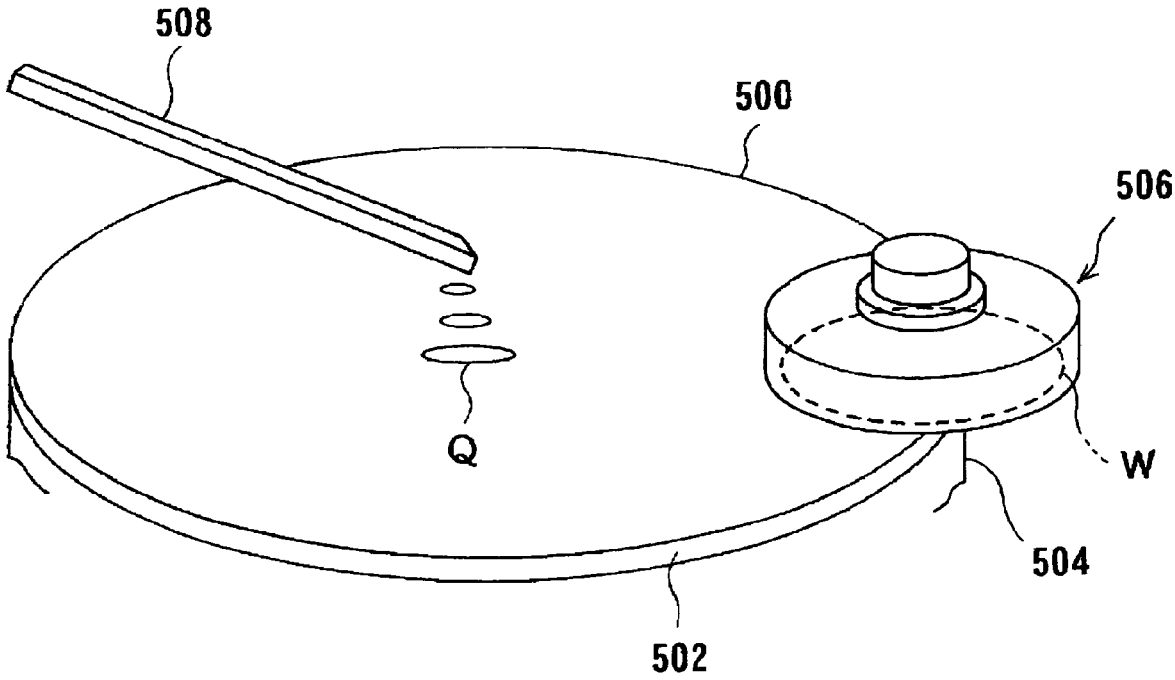
FIG. 2 is a schematic perspective view of the polishing apparatus shown in FIG. 1, illustrating the operation of making a workpiece overhang a polishing surface.
Figure 3:
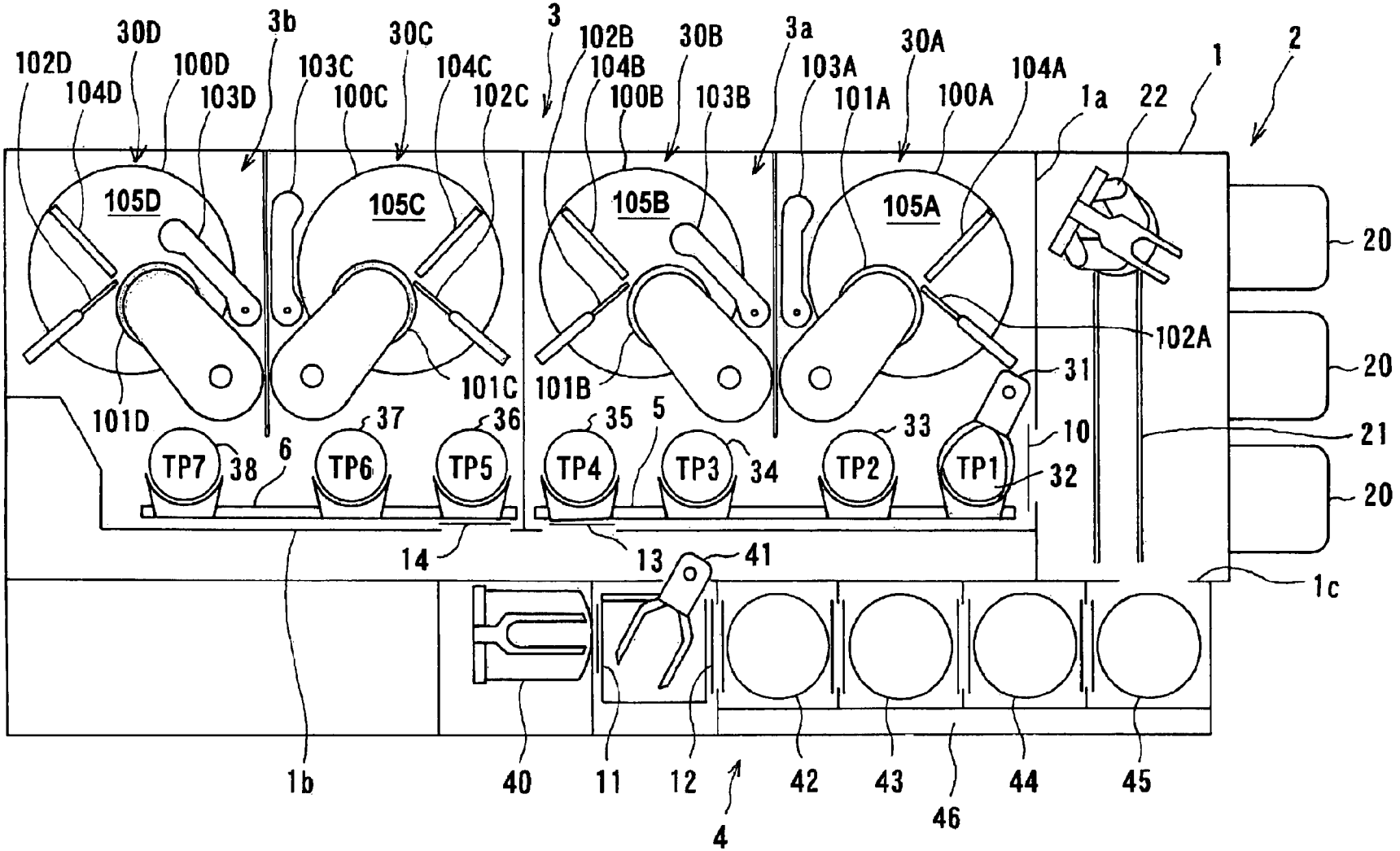
FIG. 3 is a plan view showing the overall construction of a polishing system provided with a polishing apparatus according to an embodiment of the present invention.
Figure 4:
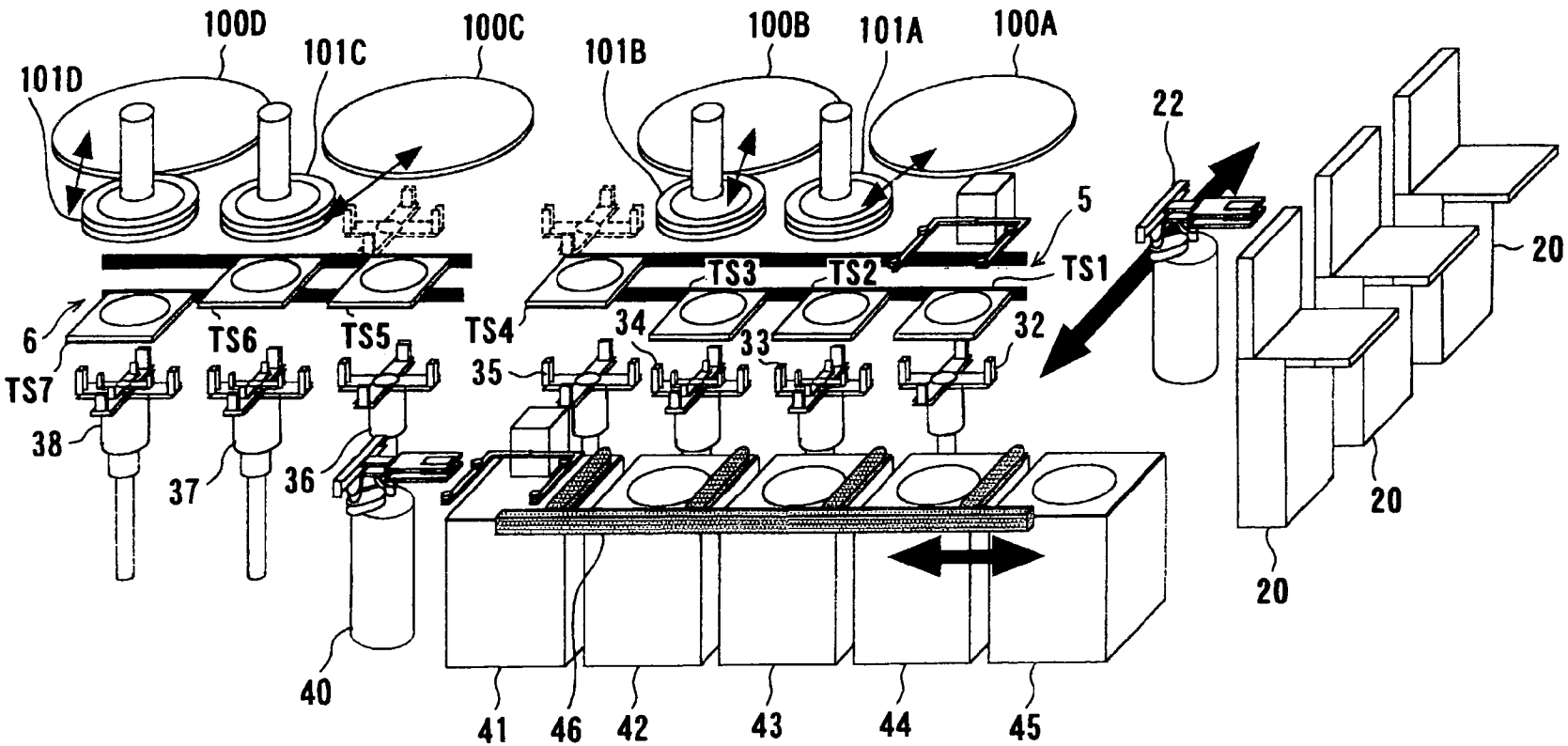
FIG. 4 is a schematic perspective view of the polishing system shown in FIG. 3.

FIG. 3 is a plan view of a polishing system incorporating a polishing apparatus according to an embodiment of the present invention, and FIG. 4 is a schematic perspective view of the polishing system shown in FIG. 3. As shown in FIG. 3, the polishing system has a housing 1 in a rectangular form. An interior space of the housing 1 is divided into a loading/unloading section 2, a polishing section 3 (3*a*, 3*b*), and a cleaning section 4 by partition walls 1*a*, 1*b*, and 1*c*. The loading/unloading section 2, the polishing sections 3*a*, 3*b*, and the cleaning section 4 are assembled independently of each other, and air is discharged from these sections independently of each other.

The loading/unloading section 2 has two or more front loading portions 20 (e.g., three in FIG. 3) on which wafer cassettes, each storing a number of semiconductor wafers as workpieces, are placed. The front loading portions 20 are arranged adjacent to each other along a width direction of the polishing system (a direction perpendicular to a longitudinal direction of the polishing system). Each of the front loading portions 20 can receive thereon an open cassette, an SMIF (Standard Manufacturing Interface) pod, or a FOUP (Front Opening Unified Pod). The SMIF and FOUP are a hermetically sealed container which houses a wafer cassette therein and covers it with a partition wall to provide an interior environment isolated from an external space.

The loading/unloading section 2 has a moving mechanism 21 extending along an arrangement direction of the front loading portions 20. A first transfer robot 22 as a first transfer mechanism is installed on the moving mechanism 21 and is movable along the arrangement direction of the front loading portions 20. The first transfer robot 22 is operable to move on the moving mechanism 21 so as to access the semiconductor wafers of the wafer cassettes mounted on the front loading portions 20. This first transfer robot 22 has vertically arranged two hands, which are separately used. For example, an upper hand can be used for returning a polished semiconductor wafer to the wafer cassette, and a lower hand can be used for transferring a non-polished semiconductor wafer.

The loading/unloading section 2 is required to be a cleanest area. Therefore, pressure in the interior of the loading/unloading section 2 is kept higher at all times than pressures in the exterior space of the apparatus, the polishing section 3 and the cleaning section 4. Further, a filter fan unit (not shown in the drawings) having a clean air filter, such as HEPA filter or ULPA filter, is provided above the moving mechanism 21 of the first transfer robot 22. This filter fan unit removes particles, toxic vapor, and toxic gas from air to produce clean air, and forms a downward flow of the clean air at all times.

The polishing section 3 is an area where a semiconductor wafer is polished. The polishing section 3 includes a first polishing section 3*a* having a first polishing apparatus 30A and a second polishing apparatus 30B therein, and a second polishing section 3*b* having a third polishing apparatus 30C and a fourth polishing apparatus 30D therein. The first polishing apparatus 30A, the second polishing apparatus 30B, the third polishing apparatus 30C, and the fourth polishing apparatus 30D are arranged along the longitudinal direction of the polishing system.

As shown in FIG. 3, the first polishing apparatus 30A includes a turntable 100A having a polishing surface 105A, a top ring 101A as a holding device for holding a semiconductor wafer and pressing the semiconductor wafer against the polishing surface 105A of the turntable 100A so as to polish the semiconductor wafer, a liquid supply nozzle 102A as a liquid supply device for supplying a slurry or a dressing liquid (e.g., pure water) onto the polishing surface 105A of the turntable 100A, a dresser 103A for dressing the polishing surface 105A of the turntable 100A, and an atomizer 104A having one or more nozzles for ejecting a mixture of a liquid (e.g., pure water) and a gas (e.g., nitrogen) in an atomized state to the polishing surface 105A. Similarly, the second polishing apparatus 30B includes a turntable 100B having a polishing surface 105B, a top ring 101B, a liquid supply nozzle 102B, a dresser 103B, and an atomizer 104B. The third polishing apparatus 30C includes a turntable 100C having a polishing surface 105C, a top ring 101C, a liquid supply nozzle 102C, a dresser 103C, and an atomizer 104C. The fourth polishing apparatus 30D includes a turntable 100D having a polishing surface 105D, a top ring 101D, a liquid supply nozzle 102D, a dresser 103D, and an atomizer 104D.

A first linear transporter 5 as a second (linear) transfer mechanism is provided between the first polishing apparatus 30A and the second polishing apparatus 30B in the first polishing section 3*a* and the cleaning section 4. This first linear transporter 5 is configured to transfer a semiconductor wafer between four transferring positions located along the longitudinal direction of the polishing system (hereinafter, these four transferring positions will be referred to as a first transferring position TP1, a second transferring position TP2, a third transferring position TP3, and a fourth transferring position TP4 in the order from the loading/unloading section 2). A reversing machine 31 for reversing a semiconductor wafer transferred from the first transfer robot 22 in the loading/unloading section 2 is disposed above the first transferring position TP1 of the first linear transporter 5. A vertically movable lifter 32 is disposed below the first transferring position TP1. A vertically movable pusher 33 is disposed below the second transferring position TP2, a vertically movable pusher 34 is disposed below the third transferring position TP3, and a vertically movable lifter 35 is disposed below the fourth transferring position TP4.

In the second polishing section 3*b*, a second linear transporter 6 as a second (linear) transfer mechanism is provided next to the first linear transporter 5. This second linear transporter 6 is configured to transfer a semiconductor wafer between three transferring positions located along the longitudinal direction of the polishing system (hereinafter, these three transferring positions will be referred to as a fifth transferring position TP5, a sixth transferring position TP6, and a seventh transferring position TP7 in the order from the loading/unloading section 2). A vertically movable lifter 36 is disposed below the fifth transferring position TP5 of the second linear transporter 6, a pusher 37 is disposed below the sixth transferring position TP6, and a pusher 38 is disposed below the seventh transferring position TP7.

As can be understood from the fact that a slurry is used during polishing, the polishing section 3 is the dirtiest area. Therefore, in order to prevent particles from spreading out of the polishing section 3, a gas is discharged from surrounding spaces of the respective turntables in this embodiment. In addition, pressure in the interior of the polishing section 3 is set to be lower than pressures in the exterior of the apparatus, the cleaning section 4, and the loading/unloading section 2, whereby scattering of particles is prevented. Typically, discharge ducts (not shown in the drawings) are provided below the turntables, respectively, and filters (not shown in the drawings) are provided above the turntables, so that downward flows of clean air are formed from the filters to the discharge ducts.

The cleaning section 4 is an area where a polished semiconductor wafer is cleaned. The cleaning section 4 includes a second transfer robot 40, a reversing machine 41 for reversing a semiconductor wafer received from the second transfer robot 40, four cleaning devices 42-45 for cleaning a polished semiconductor wafer, and a transfer unit 46 as a forth transfer mechanism for transferring a semiconductor wafer between the reversing machine 41 and the cleaning devices 42-45. The second transfer robot 40, the reversing machine 41, and the cleaning devices 42-45 are arranged in series along the longitudinal direction of the polishing system. A filter fan unit (not shown in the drawings), having a clean air filter, is provided above the cleaning devices 42-45. This filter fan unit is configured to remove particles from an air to produce a clean air, and to form downward flow of the clean air at all times. Pressure in the interior of the cleaning section 4 is kept higher than pressure in the polishing section 3, so that particles in the polishing section 3 is prevented from flowing into the cleaning section 4.

As shown in FIG. 4, the first linear transporter 5 in the first polishing section 3*a* has four transfer stages: TS1 (first stage), TS2 (second stage), TS3 (third stage), and TS4 (fourth stage), which are linearly movable in a reciprocating manner. These transfer stages have a two-line structure including an upper line and a lower line. Specifically, the first transfer stage TS1, the second transfer stage TS2, and the third transfer stage TS3 are disposed on the lower line, and the fourth transfer stage TS4 is disposed on the upper line.

The lower transfer stages TS1, TS2, and TS3 and the upper transfer stage TS4 can freely move without interfering with each other, because they are provided at different heights. The first transfer stage TS1 transfers a semiconductor wafer between the first transferring position TP1 at which the reversing machine 31 and the lifter 32 are disposed, and the second transferring position TP2, which is a wafer receiving/delivering position at which the pusher 33 is disposed. The second transfer stage TS2 transfers a semiconductor wafer between the second transferring position TP2, and the third transferring position TP3, which is a wafer receiving/delivering position at which the pusher 34 is disposed. The third transfer stage TS3 transfers a semiconductor wafer between the third transferring position TP3, and the fourth transferring position TP4 at which the lifter 35 is disposed. The fourth transfer stage TS4 transfers a semiconductor wafer between the first transferring position TP1 and the fourth transferring position TP4.

The first linear transporter 5 has an air cylinder (not shown) for linearly moving the fourth transfer stage TS4 of the upper line in a reciprocating manner. The fourth transfer stage TS4 is controlled by the air cylinder so as to be moved simultaneously with the lower transfer stages TS1, TS2, and TS3.

As shown in FIG. 4, the second linear transporter 6 has three transfer stages: TS5 (fifth stage), TS6 (sixth stage), and TS7 (seventh stage), which are linearly movable in a reciprocating manner. These transfer stages have a two-line structure including an upper line and a lower line. Specifically, a fifth transfer stage TS5 and a sixth transfer stage TS6 are disposed on an upper line, whereas a seventh transfer stage TS7 is disposed on a lower line.

The upper transfer stages TS5 and TS6 and the lower transfer stage TS7 can freely move without interfering with each other, because they are provided at different heights. The fifth transfer stage TS5 transfers a semiconductor wafer between the fifth transferring position TP5 at which the lifter 36 is disposed, and the sixth transferring position TP6, which is a wafer receiving/delivering position at which the pusher 37 is disposed. The sixth transfer stage TS6 transfers a semiconductor wafer between the sixth transferring position TP6, and the seventh transferring position TP7, which is a wafer receiving/delivering position at which the pusher 38 is disposed. The seventh transfer stage TS7 transfers a semiconductor wafer between the fifth transferring position TP5 and the seventh transferring position TP7.

The reversing machine 31 in the first polishing section 3*a* is disposed at a position to which a hand of the first transfer robot 22 in the loading/unloading section 2 is accessible and serves to receive a semiconductor wafer that has not been polished from the first transfer robot 22, reverse the semiconductor wafer upside down, and deliver the semiconductor wafer to the lifter 32. The reversing machine 41 in the cleaning section 4 is disposed at a position to which a hand of the second transfer robot 40 is accessible and serves to receive a semiconductor wafer that has been polished from the second transfer robot 40, reverse the semiconductor wafer upside down, and deliver the semiconductor wafer to the transfer unit 46.

As shown in FIG. 3, a shutter 10 is provided between the reversing machine 31 and the first transfer robot 22. When transferring a semiconductor wafer, the shutter 10 is opened, and the semiconductor wafer is delivered between the first transfer robot 22 and the reversing machine 31. Shutters 11, 12, 13, and 14 are also provided between the reversing machine 41 and the second transfer robot 40, between the reversing machine 41 and the primary cleaning device 42, between the first polishing section 3*a* and the second transfer robot 40, and between the second polishing section 3*b* and the second transfer robot 40, respectively. These shutters 11, 12, 13, and 14 are opened when a semiconductor wafer is transferred between the reversing machine 41 and the second transfer robot 40 or between the reversing machine 41 and the primary cleaning device 42. When a semiconductor wafer is not transferred, the shutters 10, 11, 12, 13, and 14 are closed.

The primary cleaning device 42 and the secondary cleaning device 43 may comprise, for example, a roll type cleaning device having upper and lower roll-shaped sponges which are rotated and pressed against front and rear surfaces of a semiconductor wafer to thereby clean the front and rear surfaces of the semiconductor wafer. The tertiary cleaning device 44 may comprise, for example, a pencil type cleaning device having a hemispherical sponge which is rotated and pressed against a semiconductor wafer to clean the semiconductor wafer. The quaternary cleaning device 45 may comprise, for example, a pencil type cleaning device which rinses a reverse side of a semiconductor wafer and rotates and presses a hemispherical sponge against a front side of the semiconductor wafer to clean the semiconductor wafer. The quaternary cleaning device 45 has a stage for rotating a chucked semiconductor wafer at a high rotational speed, and thus has a function (spin-drying function) to dry a cleaned semiconductor wafer by rotating a semiconductor wafer at a high rotational speed. In the cleaning devices 42-45, a megasonic type cleaning device which applies ultrasonic waves to a cleaning liquid to clean a semiconductor wafer may be provided in addition to the roll type cleaning device or the pencil type cleaning device described above.

The transfer unit 46 of the cleaning section 4 can transfer semiconductor wafers simultaneously from the reversing machine 41 to the primary cleaning device 42, from the primary cleaning device 42 to the secondary cleaning device 43, from the secondary cleaning device 43 to the tertiary cleaning device 44, and from the tertiary cleaning device 44 to the quaternary cleaning device 45, respectively. Since a semiconductor wafer can be transferred within a cleaning device to the next cleaning device without being taken out of the cleaning devices, the stroke required for transferring semiconductor wafers can be minimized, and the time required for transferring semiconductor wafers can be reduced.

Next, the polishing apparatuses 30A, 30B, 30C, and 30D in the polishing section 3 will be described below. These polishing apparatuses 30A, 30B, 30C, and 30D have substantially the same structure, and only the first polishing unit 30A will be described below.

Figure 5:
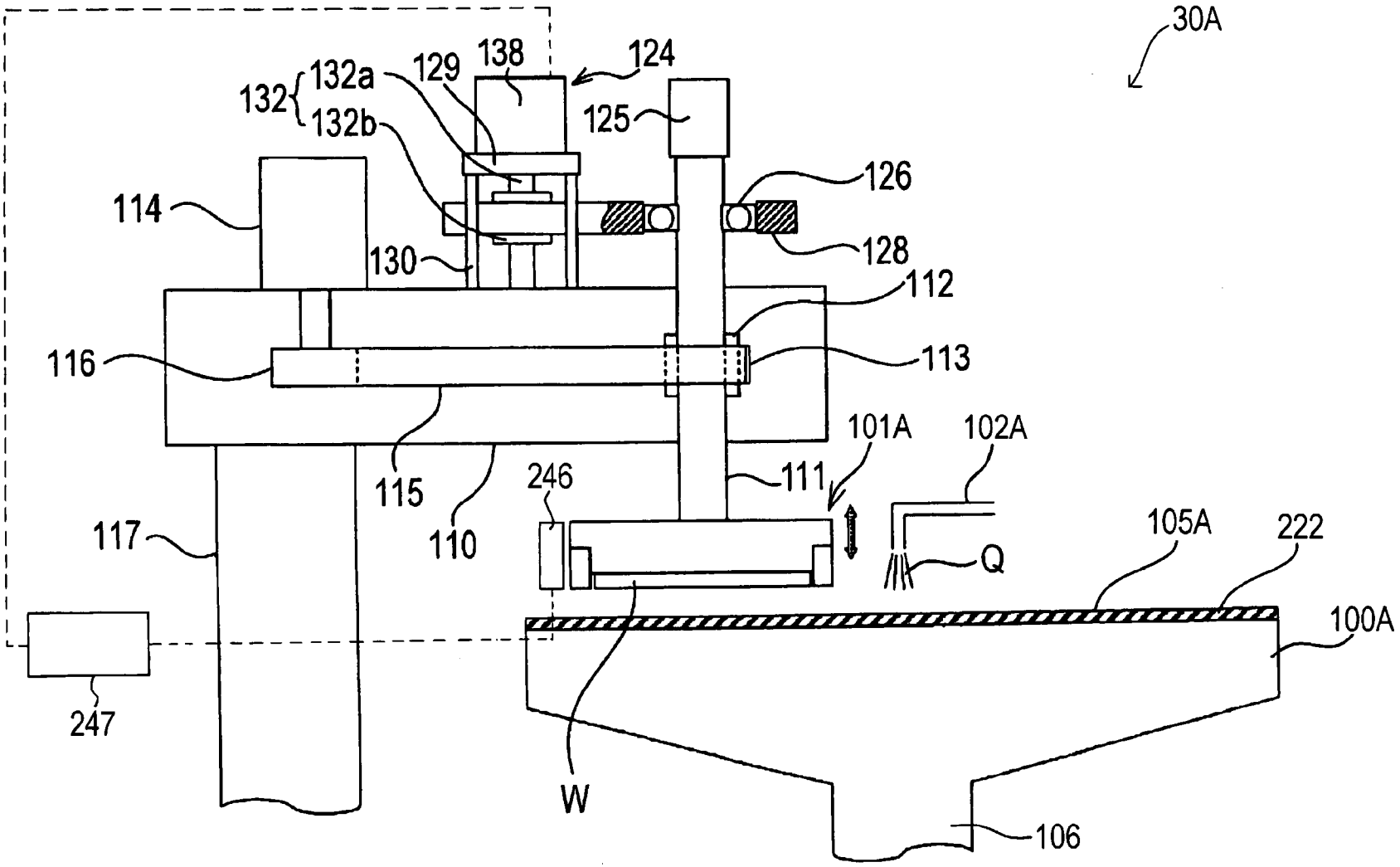
FIG. 5 is a schematic view of the polishing apparatus of the polishing system shown in FIG. 3.
Figure 6:
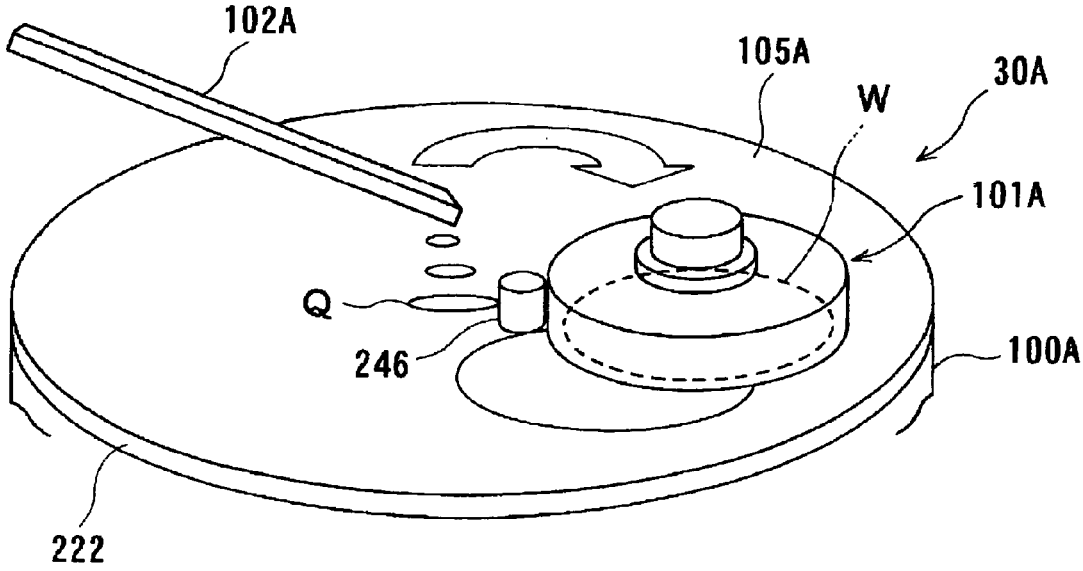
FIG. 6 is a schematic perspective view of the main portion of the polishing apparatus shown in FIG. 5.

FIG. 5 is a schematic view showing an entire structure of the polishing apparatus 30A, and FIG. 6 is a schematic perspective view of the main portion of the polishing apparatus 30A. As shown in FIG. 5, the polishing apparatus 30A comprises the turntable 100A, and the top ring 101A for holding a semiconductor wafer W and pressing the semiconductor wafer W against the polishing surface 105A of the turntable 100A.

The turntable 100A is coupled via a table shaft 106 to a motor (not shown) disposed below the turntable 100A. Thus, the turntable 100A is rotatable about the table shaft 106. A polishing pad 222 is attached to an upper surface of the turntable 100A. An upper surface of the polishing pad 222 constitutes the polishing surface 105A to polish a semiconductor wafer W. The liquid supply nozzle 102A is provided above the turntable 100A to supply a liquid Q, such as polishing liquid, onto the polishing pad 222 on the turntable 100A.

The top ring 101A is connected to a lower end of a top ring shaft 111, which is vertically movable with respect to a top ring head 110 by a vertically moving mechanism 124. When the vertically moving mechanism 124 moves the top ring shaft 111 vertically, the top ring 101A is lifted and lowered as a whole for positioning with respect to the top ring head 110. A rotary joint 125 is mounted on the upper end of the top ring shaft 111.

The vertically moving mechanism 124 for vertically moving the top ring shaft 111 and the top ring 101A comprises a bridge 128 on which the top ring shaft 111 is rotatably supported by a bearing 126, a ball screw 132 mounted on the bridge 128, a support base 129 supported by support posts 130, and an AC servomotor 138 mounted on the support base 129. The support base 129, which supports the AC servomotor 138 thereon, is fixedly mounted on the top ring head 110 by the support posts 130.

The ball screw 132 comprises a screw shaft 132*a* coupled to the AC servomotor 138 and a nut 132*b* threaded over the screw shaft 132*a*. The top ring shaft 111 is vertically movable in unison with the bridge 128 by the vertically moving mechanism 124. Therefore, when the AC servomotor 138 is energized, the bridge 128 moves vertically via the ball screw 132, and the top ring shaft 111 and the top ring 101A move vertically.

The top ring shaft 111 is connected to a rotary sleeve 112 by a key (not shown). The rotary sleeve 112 has a timing pulley 113 fixedly disposed therearound. A top ring motor 114 having a drive shaft is fixed to the top ring head 110. The timing pulley 113 is operatively coupled to a timing pulley 116 mounted on the drive shaft of the top ring motor 114 by a timing belt 115. Therefore, when the top ring motor 114 is energized, the timing pulley 116, the timing belt 115, and the timing pulley 113 are rotated to rotate the rotary sleeve 112 and the top ring shaft 111 in unison, thus rotating the top ring 101A. The top ring head 110 is supported on a top ring head shaft 117 pivotably supported on a frame (not shown).

In the polishing apparatus 30A constructed as shown in FIG. 5, the top ring 101A is configured to hold a semiconductor wafer W on its lower surface. The top ring head 110 is pivotable (swingable) about the top ring head shaft 117. Thus, the top ring 101A, which holds the semiconductor wafer W on its lower surface, is moved between a position at which the top ring 101A receives the semiconductor wafer W and a position above the turntable 100A by pivotal movement of the top ring head 110. The top ring 101A is lowered to press the semiconductor wafer W against the polishing surface 105A of the polishing pad 222. At this time, while the top ring 101A and the turntable 100A are respectively rotated, a liquid (polishing liquid having abrasive particles) Q is supplied onto the polishing pad 222 by the liquid supply nozzle 102A provided above the turntable 100A. Alternatively, a liquid supplying device, disposed below the polishing pad 222 (not shown), other than the liquid supply nozzle 102A may be used for supplying a liquid Q onto the polishing pad 222. The semiconductor wafer W is brought into sliding contact with the polishing surface 105A of the polishing pad 222. Thus, a surface of the semiconductor wafer W is polished.

The servomotor 138 of the vertically moving mechanism 124 desirably is a stepping motor or an AC servomotor, which can control a rotational angle, because of the need to perform vertical positioning of the top ring 101A. It is possible to use a cylinder instead of the servomotor 138 and the ball screw 132.

As shown in FIGS. 5 and 6, the polishing apparatus 30A is provided with a liquid film thickness detection sensor 246, located lateral to the top ring 101A, for measuring a thickness of the liquid, or liquid film Q, which has been supplied from the liquid supply nozzle 102A to the polishing surface 105A and is held in a film-like form on the polishing surface 105A, at a point downstream of the top ring 101A. The liquid film thickness detection sensor 246, i.e., a detector for detecting a thickness of a liquid film, is capable of detecting a change in the thickness of the liquid (liquid film) Q, covering the polishing surface 105A, at the point downstream of the top ring 101A. Thus, it is possible to confirm or sense whether the semiconductor wafer W has detached from the polishing surface 105A and attached to the top ring 101A, during a lift-off operation for the semiconductor wafer W or at least after the start of the operation of detachment of the wafer W, as will be described later. Any sensor that is capable of detecting the thickness of the liquid film, such as a laser sensor, an ultrasonic sensor, a contact sensor or a capacitance sensor, may be used as the liquid film thickness detection sensor 246.

The output of the liquid film thickness detection sensor 246 or signals generated by the sensor 246 is inputted into a control device 247. The control device 247 receives the signals from the liquid film detection sensor 246 and processes the calculations so as to confirm whether the semiconductor wafer W has detached from the polishing surface 105A and attached to the top ring 101A. The control device 247 then sends the output or signals for controlling a plurality of devices located inside the polishing apparatus so as to move the device, based on the confirmation thereby reducing adverse effect causing deformation of the semiconductor wafer W. Thus, the servomotor 138 of the vertically moving mechanism 124 which is movable vertically is controlled by the output from the control device 247. The control device 247 controls various devices of the polishing apparatus 30A so as to control the amount of the liquid Q to be supplied from the liquid supply nozzle 102A to the polishing surface 105A, the rotational speed of the turntable 100A and the rotational speed of the top ring 101A, the pressure of the below-described fluid supplied into the top ring 101A, etc.

FIGS. 7 through 11 are vertical sectional views showing the top ring 101A along a plurality of radial directions of the top ring 101A.

Figure 7:
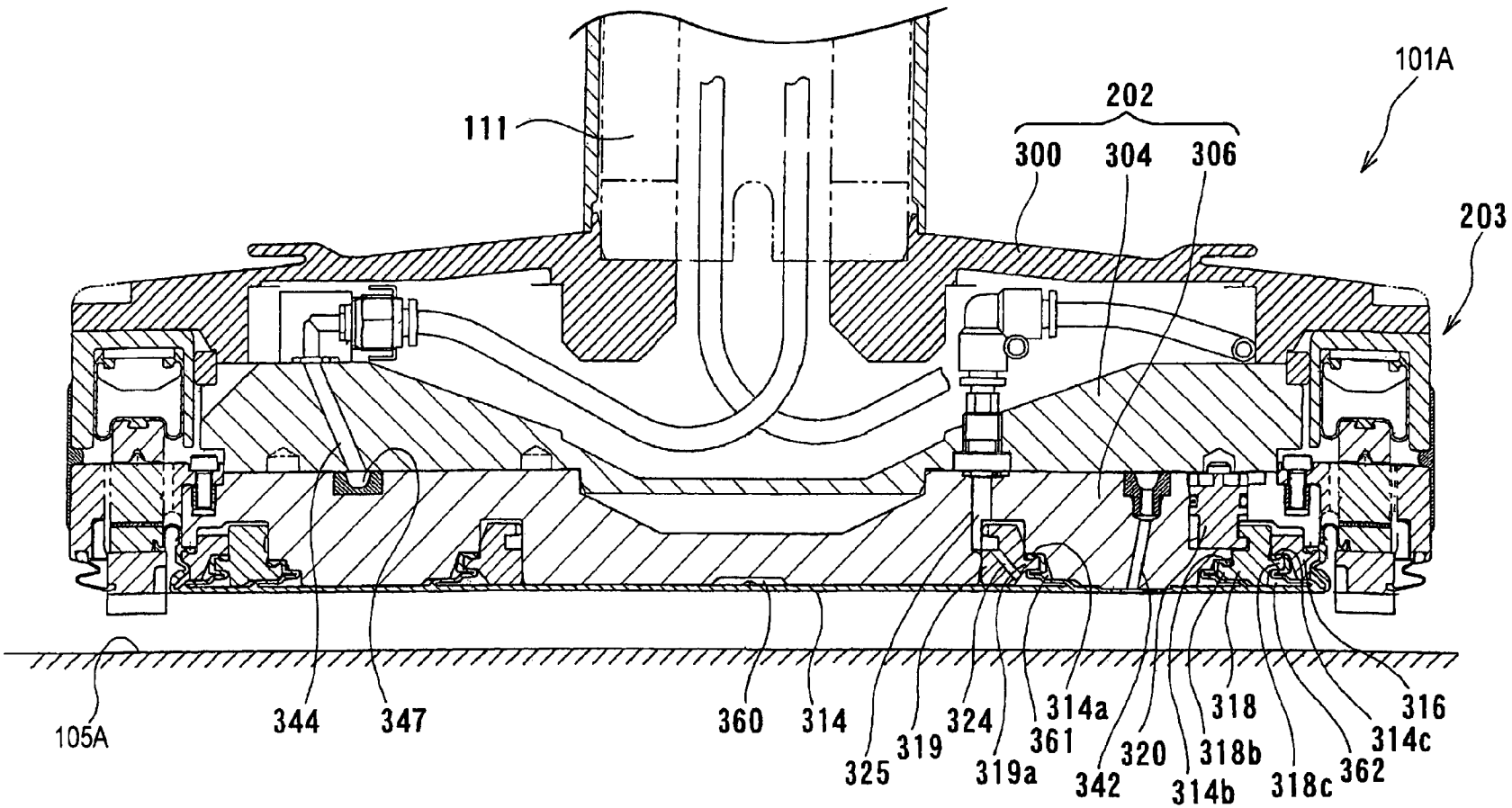
FIG. 7 is a vertical sectional view of a top ring shown in FIG. 5.
Figure 8:
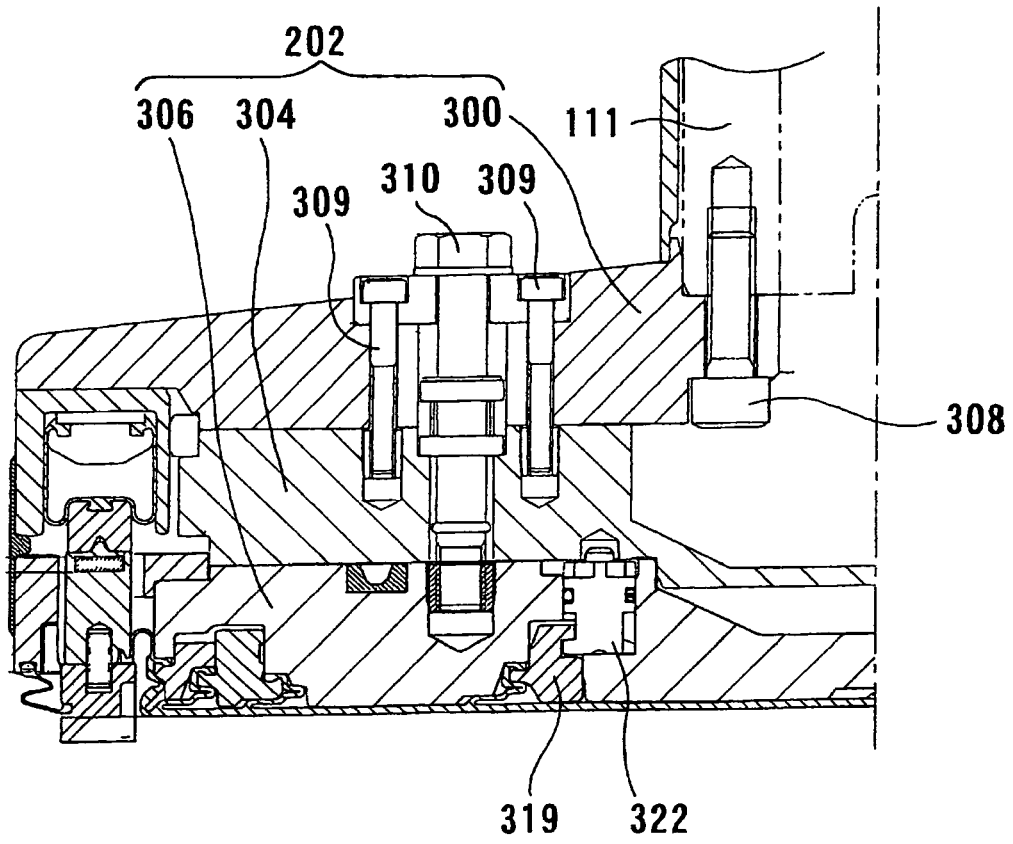
FIG. 8 is a vertical sectional view of the top ring shown in FIG. 5.

As shown in FIGS. 7 through 11, the top ring 101A basically comprises a top ring body 202 for pressing a semiconductor wafer W against the polishing surface 105A, and a retainer ring 203 for directly pressing the polishing surface 105A. The top ring body 202 includes an upper member 300 in the form of a circular plate, an intermediate member 304 attached to a lower surface of the upper member 300, and a lower member 306 attached to a lower surface of the intermediate member 304. The retainer ring 203 is attached to a peripheral portion of the upper member 300. As shown in FIG. 8, the upper member 300 is connected to the top ring shaft 111 by bolts 308. Further, the intermediate member 304 is fixed to the upper member 300 by bolts 309, and the lower member 306 is fixed to the upper member 300 by bolts 310. The top ring body 202 comprising the upper member 300, the intermediate member 304, and the lower member 306 is made of resin such as engineering plastics (e.g., PEEK).

As shown in FIG. 7, the top ring 101A has an elastic membrane 314 attached to a lower surface of the lower member 306. The elastic membrane 314 is brought into contact with a rear face of a semiconductor wafer held by the top ring 101A. The elastic membrane 314 is held on the lower surface of the lower member 306 by an annular edge holder 316 disposed radially outward and annular ripple holders 318, 319 disposed radially inward of the edge holder 316. The elastic membrane 314 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. As shown in FIG. 8, the ripple holder 319 is held on the lower surface of the lower member 306 by a plurality of stoppers 322. The stoppers 320 and the stoppers 322 are arranged along a circumferential direction of the top ring 101A at equal intervals.

As shown in FIG. 7, a central chamber 360 is formed at a central portion of the elastic membrane 314. The ripple holder 319 has a passage 324 communicating with the central chamber 360. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 360 formed by the elastic membrane 314.

The ripple holder 318 has claws 318*b*, 318*c* for pressing a ripple 314*b* and an edge 314*c* of the elastic membrane 314 against the lower surface of the lower member 306. The ripple holder 319 has a claw 319*a* for pressing a ripple 314*a* of the elastic membrane 314 against the lower surface of the lower member 306.

Figure 9:
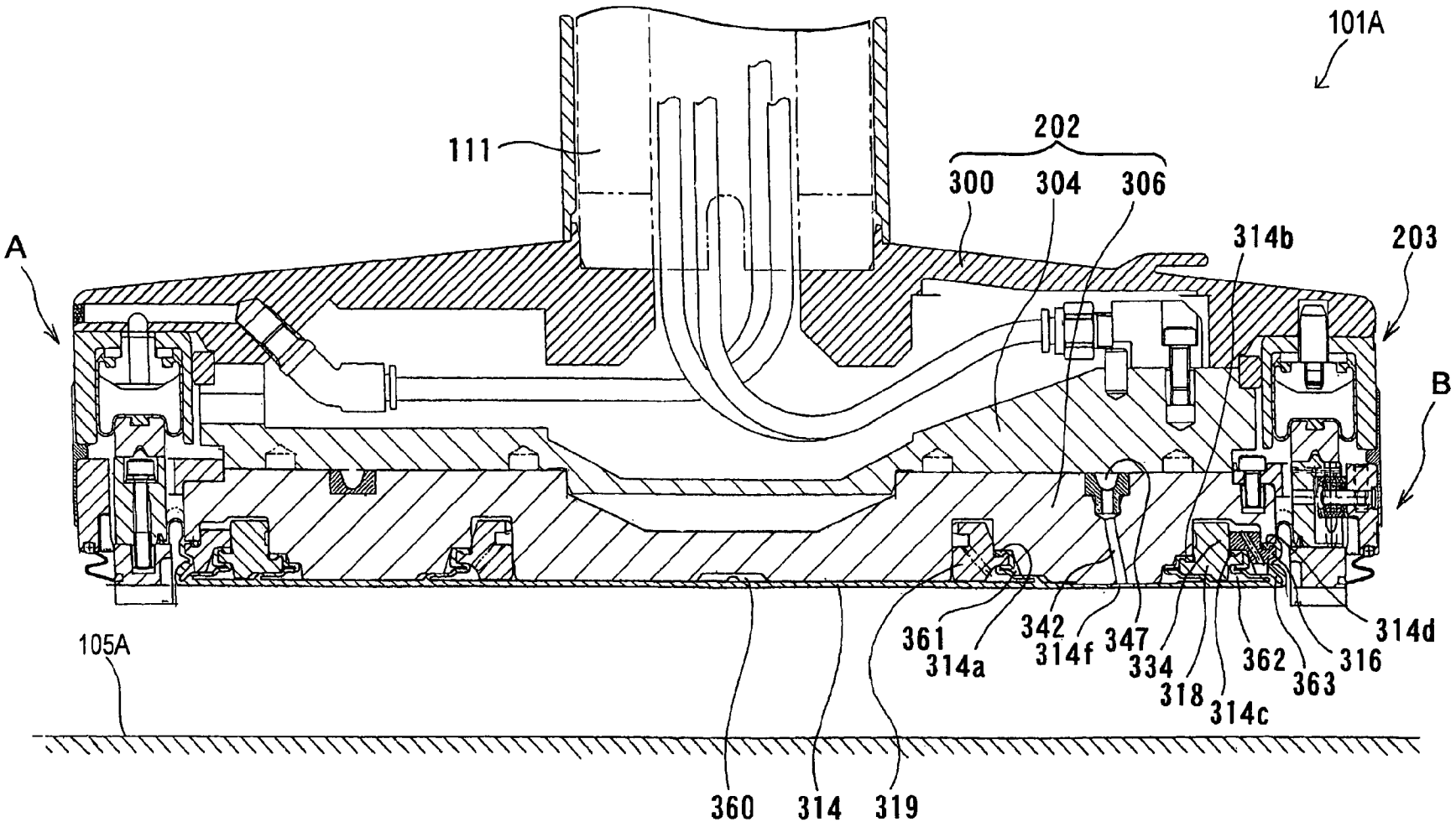
FIG. 9 is a vertical sectional view of the top ring shown in FIG. 5.

As shown in FIG. 9, an annular ripple chamber 361 is formed between the ripple 314*a* and the ripple 314*b* of the elastic membrane 314. A gap 314*f* is formed between the ripple holder 318 and the ripple holder 319 of the elastic membrane 314. The lower member 306 has a passage 342 communicating with the gap 314*f*. Further, as shown in FIG. 7, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through these passages to the ripple chamber 361. Further, the passage 342 is selectively connected to a vacuum pump (not shown) When the vacuum pump is operated, a semiconductor wafer is attracted to the lower surface of the elastic membrane 314 by suction, thereby chucking the semiconductor wafer.

Figure 10:
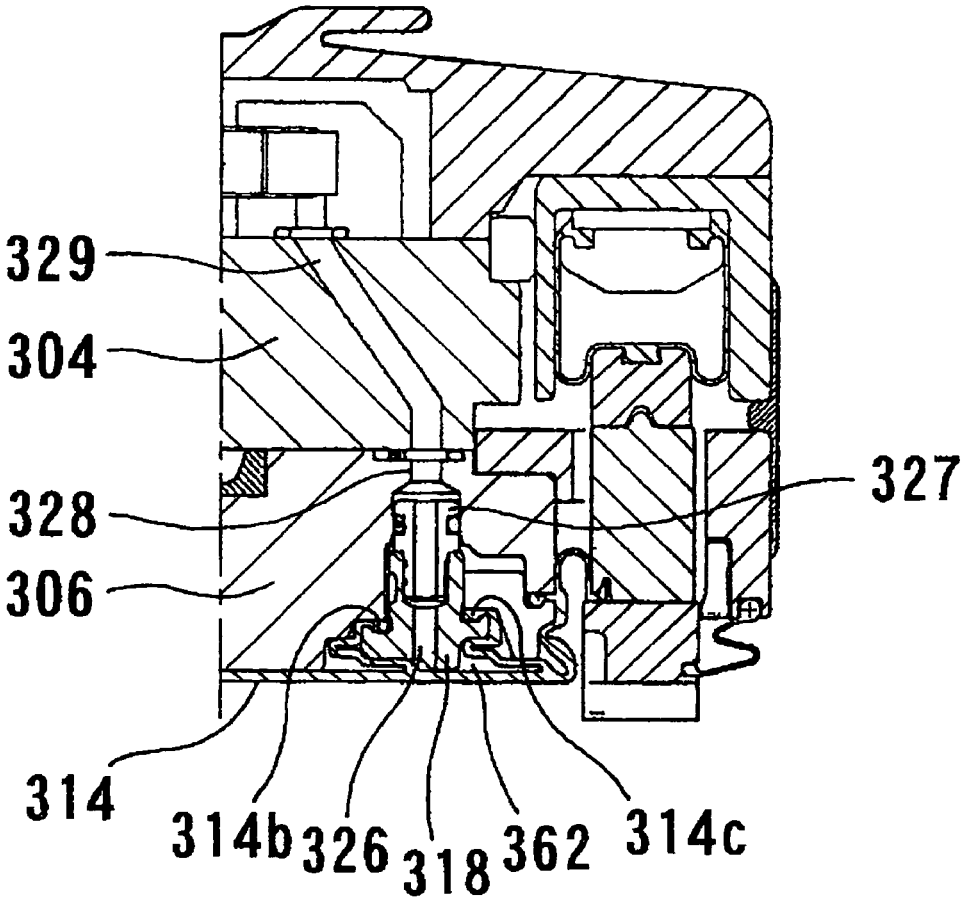
FIG. 10 is a vertical sectional view of the top ring shown in FIG. 5.

As shown in FIG. 10, the ripple holder 318 has a passage 326 communicating with an annular outer chamber 362 formed by the ripple 314*b* and the edge 314*c* of the elastic membrane 314. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through these passages to the outer chamber 362 formed by the elastic membrane 314.

Figure 11:
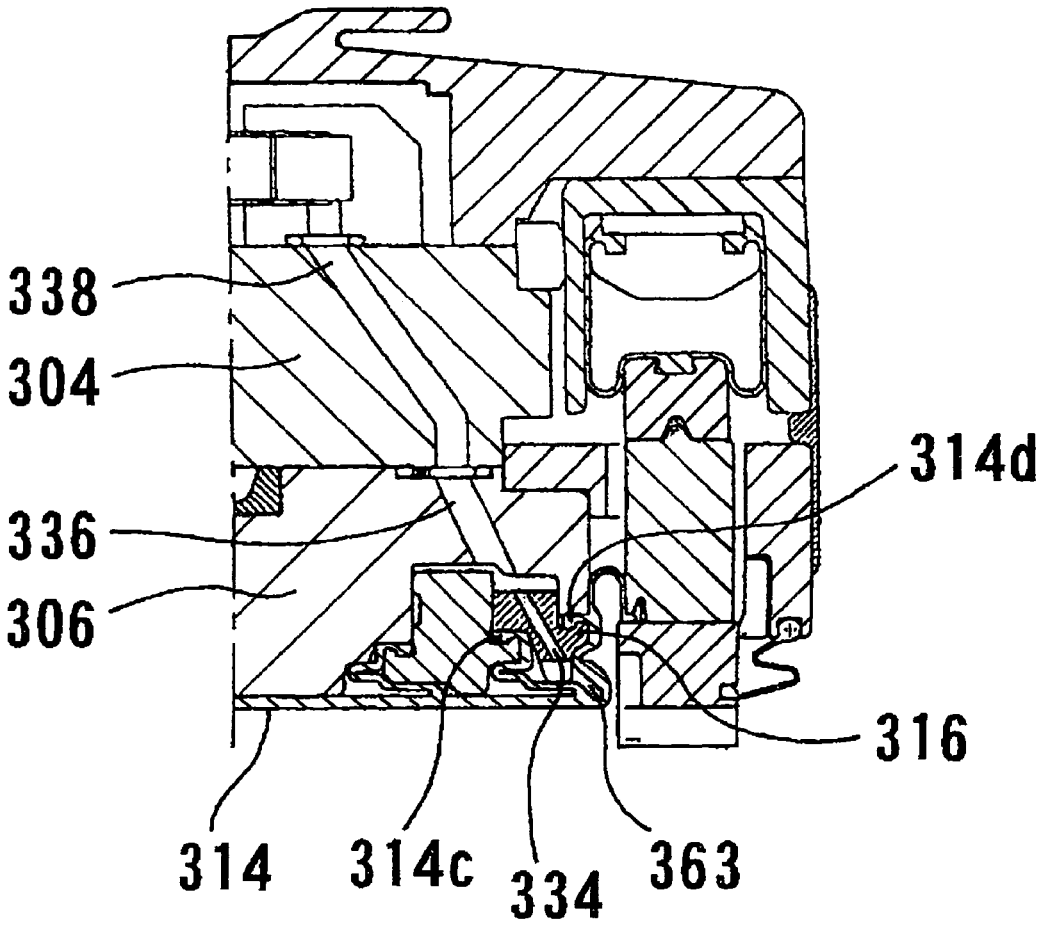
FIG. 11 is a vertical sectional view of the top ring shown in FIG. 5.

As shown in FIG. 11, the edge holder 316 has a claw for holding an edge 314*d* of the elastic membrane 314 on the lower surface of the lower member 306. The edge holder 316 has a passage 334 communicating with an annular edge chamber 363 formed by the edges 314*c* and 314*d* of the elastic membrane 314. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source (not shown). Thus, a pressurized fluid is supplied through these passages to the edge chamber 363 formed by the elastic membrane 314.

As described above, in the top ring 101A, pressing forces for pressing a semiconductor wafer against the polishing pad 222 can be adjusted at local areas of the semiconductor wafer by adjusting pressures of fluids to be supplied to the respective pressure chambers formed between the elastic membrane 314 and the lower member 306 (i.e., the central chamber 360, the ripple chamber 361, the outer chamber 362, and the edge chamber 363).

Figure 12:
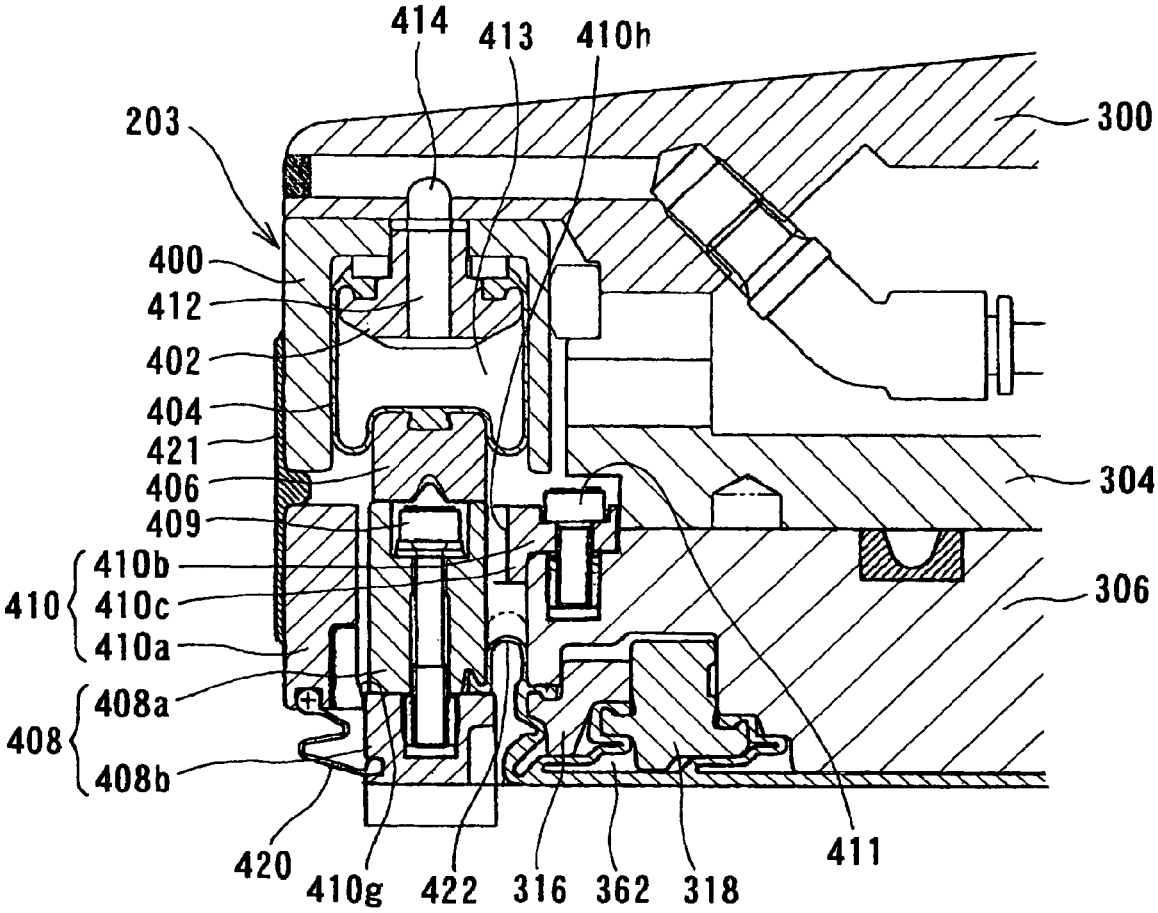
FIG. 12 is a vertical sectional view of the top ring shown in FIG. 5.

FIG. 12 is an enlarged view of the retainer ring 203. The retainer ring 203 serves to hold a peripheral edge of a semiconductor wafer. The retainer ring 203 comprises a cylinder 400 having a cylindrical shape with a closed upper end, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406.

The ring member 408 comprises an upper ring member 408*a* coupled to the piston 406, and a lower ring member 408*b* which is brought into contact with the polishing surface 105A. The upper ring member 408*a* and the lower ring member 408*b* are coupled by a plurality of bolts 409. The upper ring member 408*a* is composed of a metal material such as SUS or a material such as ceramics, and the lower ring member 408*b* is made of a resin material such as PEEK or PPS.

The holder 402 has a passage 412 communicating with a chamber 413 formed by the elastic membrane 404. The upper member 300 has a passage 414 communicating with the passage 412 of the holder 402. The passage 412 of the holder 402 is connected via the passage 414 of the upper member 300 to a fluid supply source (not shown). Thus, a pressurized fluid is supplied through these passages to the chamber 413. Accordingly, by adjusting a pressure of the fluid to be supplied to the pressure chamber 413, the elastic membrane 404 can be expanded and contracted so as to vertically move the piston 406. Thus, the ring member 408 of the retainer ring 203 can be pressed against the polishing pad 222 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 203 presses the polishing pad 222 can accurately be adjusted.

With the above arrangement, only the ring member 408 of the retainer ring 203 can be lowered. Accordingly, a constant distance can be maintained between the lower member 306 and the polishing pad 222 even if the ring member 408 of the retainer ring 203 is worn out. Further, since the ring member 408, which is brought into contact with the polishing pad 222, and the cylinder 400 are connected by the deformable elastic membrane 404, no bending moment is produced by offset loads. Thus, surface pressures by the retainer ring 203 can be made uniform, and the retainer ring 203 becomes more likely to follow the polishing pad 222.

Further, as shown in FIG. 12, the retainer ring 203 has a ring-shaped retainer ring guide 410 for guiding vertical movement of the ring member 408. The ring-shaped retainer ring guide 410 comprises an outer peripheral portion 410*a* located at an outer circumferential side of the ring member 408 so as to surround an entire circumference of an upper portion of the ring member 408, an inner peripheral portion 410*b* located at an inner circumferential side of the ring member 408, and an intermediate portion 410*c* configured to connect the outer peripheral portion 410*a* and the inner peripheral portion 410*b*. The inner peripheral portion 410*b* of the retainer ring guide 410 is fixed to the lower member 306 of the top ring 101A by a plurality of bolts 411. The intermediate portion 410*c* configured to connect the outer peripheral portion 410*a* and the inner peripheral portion 410*b* has a plurality of openings 410*h* which are formed at equal intervals in a circumferential direction of the intermediate portion 410*c*.

Next, processing of a semiconductor wafer as a workpiece by the polishing apparatus 30A having the above construction will now be described.

First, the top ring 101A attracts by suction a semiconductor wafer W, which has been transported to the pusher 33, and holds the semiconductor wafer inside the retainer ring 203 of the top ring 101A. The top ring 101A then pivots from above the pusher 33 to above the polishing surface 105A of the turntable 100A. Thereafter, while rotating the top ring 101A at a predetermined rotational speed, the top ring 101A is lowered by the vertically moving mechanism 124 toward the polishing surface 105A of the turntable 100A which is rotating at a predetermined rotational speed.

The end point of the lowering of the top ring 101A is controlled at a predetermined height by controlling the pulse number of the servomotor 138 in this embodiment in which the servomotor 138 and the ball screw 132 are used as the vertically moving mechanism 124. If a cylinder is used as a vertical movement mechanism, the lowering of the top ring will be stopped at the stroke end of the cylinder or when the top ring comes into contact with the polishing pad. The ring member 408 of the retainer ring 203 of the top ring 101A needs to be brought into contact with the polishing pad 222.

Since the ring member 408 of the retainer ring 203 is to be pressed by the chamber 413 formed by the elastic membrane 404, the top ring 101A is preferably positioned at a predetermined height from the polishing pad 222.

If the top ring 101A is so constructed that the ring member 408 is directly secured to the upper member 300 (the case not shown), the top ring 101A is preferably stopped on its contact position with the polishing pad 222.

Next, while supplying a slurry (liquid Q) at a predetermined flow rate from the liquid supply nozzle 102A to the polishing surface 105A, pressurized fluids at predetermined pressures are supplied to the center chamber 360, the ripple chamber 361, the outer chamber 362, and the edge chamber 363 of the top ring 101A to press the semiconductor wafer W, held by the top ring 101A, against the polishing surface 105A of the turntable 100A at a controlled predetermined pressure, thereby rubbing and polishing the surface, i.e., the surface to be polished, of the semiconductor wafer W with the polishing surface 105A in the presence of the slurry. During the polishing, a gap of about 0.1 mm to 3 mm is formed between the lower member 306 and the elastic membrane 314 so as to allow the pressurized fluids to be present over an entire area of the elastic membrane 314, thereby avoiding physical contact between the lower member 306 and the elastic membrane 314 and pressing on the semiconductor wafer W by the internal pressure of the elastic membrane 314.

After the termination of the intended polishing process (the termination of the polishing process is managed, e.g., by the polishing time or a thickness of a film being polished), the process is shifted to a lift-off operation for the semiconductor wafer. The lift-off operation for the semiconductor wafer will now be described with reference to FIGS. 13 through 15.

Figure 13:
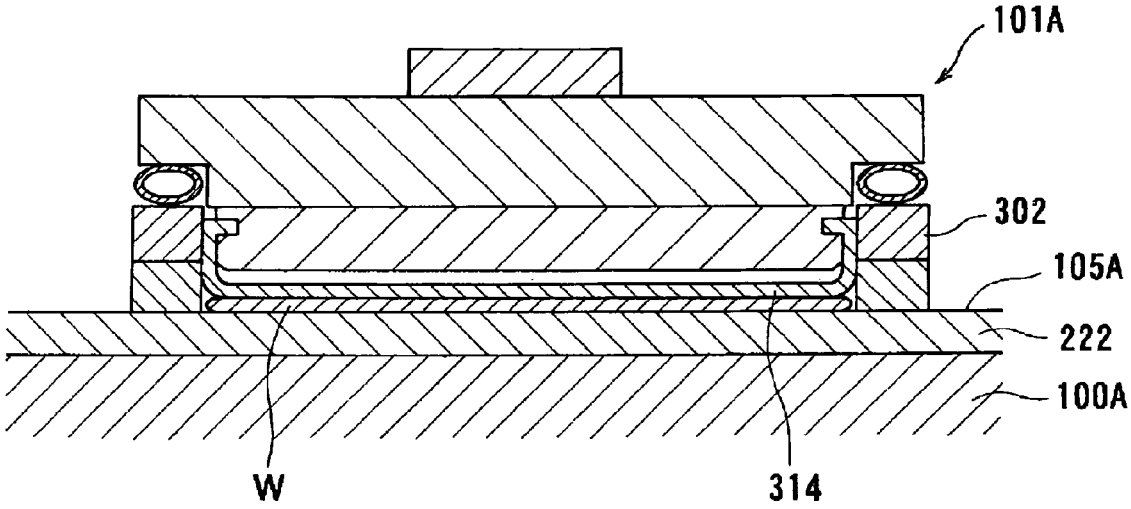
FIG. 13 is a vertical sectional diagram illustrating a lift-off operation for a semiconductor wafer, showing the operation at the start of attraction of the semiconductor wafer to the top ring.
Figure 14:
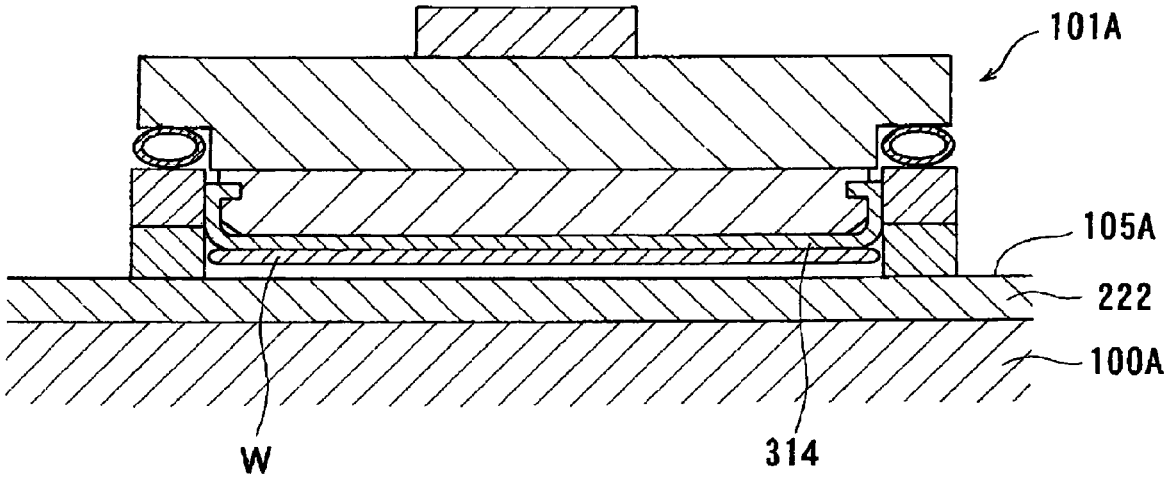
FIG. 14 is a vertical sectional diagram illustrating the lift-off operation for the semiconductor wafer upon attachment of the semiconductor wafer to the top ring.

FIG. 13 shows the state of the top ring 101A and the semiconductor wafer W immediately after the termination of polishing. Upon the termination of polishing, the press of the center chamber 360, the ripple chamber 361, the outer chamber 362 and the edge chamber 363 of the top ring 101A is stopped while rotating the turntable 100A and the top ring 101A. At this time, the semiconductor wafer W is in contact with the polishing surface 105A of the polishing pad 222. Thereafter, as shown in FIG. 14, the ripple chamber 361 of the top ring 101A is vacuumed to detach the semiconductor wafer W from the polishing surface 105A and attach the semiconductor wafer W to the lower surface of the top ring 101A, i.e., the surface of the elastic membrane 314, without making the semiconductor wafer W overhang the turntable 100A by about ⅓ of the diameter.

A stress that acts on the semiconductor wafer when it is attached to the top ring 101A is, in most cases, not problematic because of small deformation of the wafer. A force that lifts up the top ring 101A later is larger than the attraction force on the semiconductor wafer in order to securely perform the operation. When the semiconductor wafer W is in contact with the polishing surface 105A, the polishing surface 105A and the top ring 101A both attract the semiconductor wafer W.

The attraction force of the top ring 101A, which acts on the semiconductor wafer before the top ring 101A lifts up, must be larger than the attraction force produced between the polishing pad and the semiconductor wafer. Thus, the attraction pressure of the top ring on the semiconductor wafer is generally set at about −80 kPa. On the other hand, such attraction force as −80 kPa is too strong upon transfer of the semiconductor wafer other than its lift-off: the strong attraction force can deform the semiconductor wafer and produce such a large stress as to destroy a circuit formed on the semiconductor wafer. For transport of the semiconductor wafer, therefore, it is desirable to use a different attraction pressure of the top ring on the semiconductor wafer from that used for lift-off of the semiconductor wafer. For example, the attraction pressure of the top ring on the semiconductor wafer may be about −80 kPa upon lift-off of the semiconductor wafer, and about −30 kPa upon transport of the semiconductor wafer.

The use of a low attraction force of the top ring on the semiconductor wafer is preferred also when detaching the semiconductor wafer from the polishing pad. Thus, the stress that acts on the semiconductor wafer can be reduced by gradually increasing the degree of vacuum until the semiconductor wafer detaches from the polishing pad while monitoring the semiconductor wafer with a means for detecting detachment of the semiconductor wafer from the polishing pad. The vacuum pressure may be controlled by an automatic pressure regulator such as auto regulator or by using a plurality of manual regulators in combination with a switching valve. For example, the semiconductor wafer attracting operation may be carried out by stepwise increasing the degree of vacuum as follows: −30 kPa in the first step; −60 kPa in the second step; and −80 kPa in the third step. Upon detection of detachment of the semiconductor wafer from the polishing pad, the top ring is lifted while holding the semiconductor wafer at the final attraction pressure (vacuum pressure). Thereafter, the attraction pressure is switched to an attraction pressure for use in usual transport of the semiconductor wafer, for example −30 kPa, so as to reduce the stress acting on the semiconductor wafer.

Upon the start of the wafer attracting operation, the slurry has been switched to pure water and pure water has been supplied to the polishing surface 105A. Accordingly, pure water (liquid Q) is present between the semiconductor wafer W and the polishing surface 105A. The gap between the semiconductor wafer W and the polishing surface 105A, formed by the presence of pure water, changes with the relative speed between the semiconductor wafer and the polishing surface and with the amount of pure water supplied. When an attraction force of the top ring 101A begins to act on the semiconductor wafer W, the semiconductor wafer W deforms into a sucker-like shape in the range of the gap. The sucker-like deformation of the semiconductor wafer W occurs in the presence of a viscous liquid such as water.

In this embodiment, the amount of pure water (liquid Q) to be supplied from the liquid supply nozzle 102A to the polishing surface 105A is decreased when the attraction force of the top ring 101A begins to act on the semiconductor wafer W. This allows air to enter the gap between the semiconductor wafer W and the polishing surface 105A as the semiconductor wafer W becomes gradually attached by the attraction force to the top ring 101A, thereby enabling to decrease the attraction force that attracts the semiconductor wafer W to the polishing surface 105A, i.e., the negative pressure produced between the semiconductor wafer W and the polishing surface 105A.

The supply of pure water from the liquid supply nozzle 102A to the polishing surface 105A is to prevent the semiconductor wafer W after polishing from being scratched by contact with the polishing surface 105A and, in addition, to clean and cool the polishing surface 105A and the semiconductor wafer W.

The polishing surface 105A is in contact with and moves relative to the ring member 408 of the retainer ring 203 of the top ring 101A even during the operation of attracting the semiconductor wafer W to the top ring 101A. It is therefore preferred that the amount of the liquid to be supplied to the polishing surface 105A be decreased at most to such an amount as not to dry out the polishing surface 105A and the ring member 408.

Figure 15:
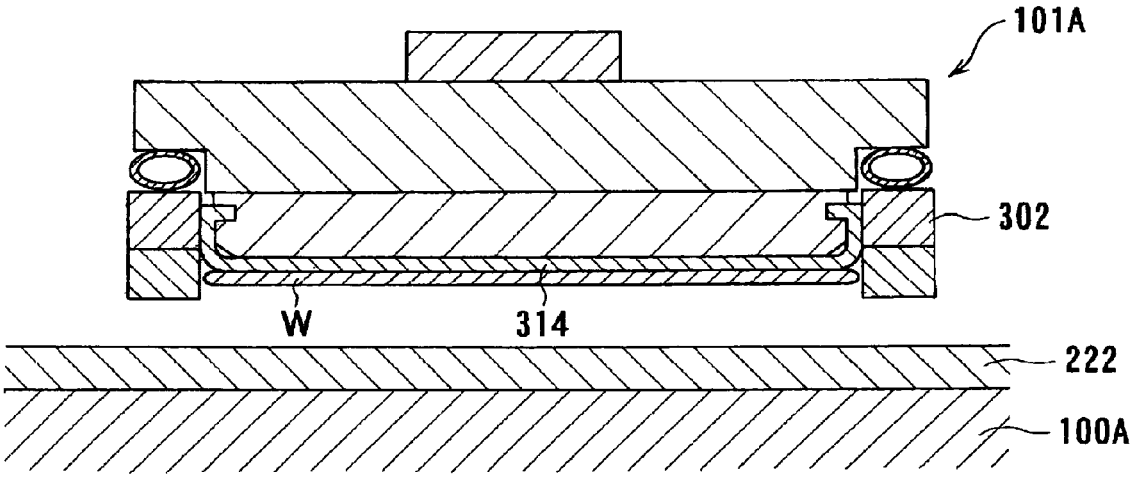
FIG. 15 is a vertical sectional diagram illustrating the lift-off operation for the semiconductor wafer upon lifting of the top ring with the semiconductor wafer attached thereto.

Upon confirmation of detachment of the semiconductor wafer W from the polishing surface 105A and attachment of the semiconductor wafer W to the top ring 101A, the servomotor 138 of the vertically moving mechanism 124 is actuated to lift up the top ring 101A together with the semiconductor wafer W, as shown in FIG. 15, thereby completing the lift-off operation for the semiconductor wafer W. By thus lifting up the top ring 101A immediately after the semiconductor wafer W has detached from the polishing surface 105A and attached to the top ring 101A, it becomes possible to make the best use of the processing capacity of the apparatus. Further, breakage of the semiconductor wafer W and failure to pick up the semiconductor wafer W can be prevented by not forcibly detaching the semiconductor wafer W from the polishing surface 105A.

In this embodiment, a confirmation or a determination as to whether the semiconductor wafer W has detached from the polishing surface 105A and attached to the top ring 101A is made during the lift-off operation for the semiconductor wafer W by detecting a change in a thickness of the liquid (liquid film) Q, covering the polishing surface 105A in a film-like form, at a point downstream of the top ring 101A by the liquid film thickness detection sensor 246 (see FIGS. 5 and 6) located lateral to the top ring 101A.

Figure 16:
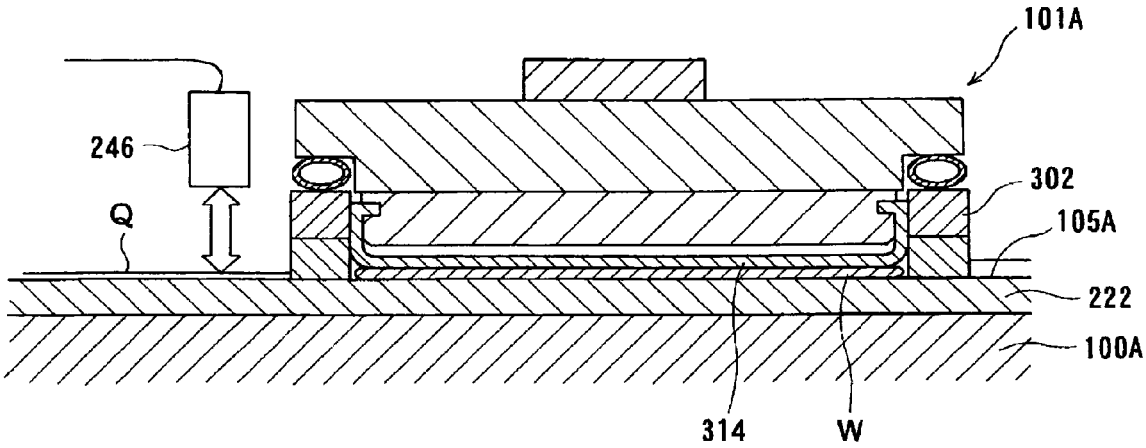
FIG. 16 is a vertical sectional diagram illustrating a thickness of a liquid film covering the polishing surface when the semiconductor wafer lies on the polishing surface before it is attached to a lower surface of the top ring.
Figure 17:
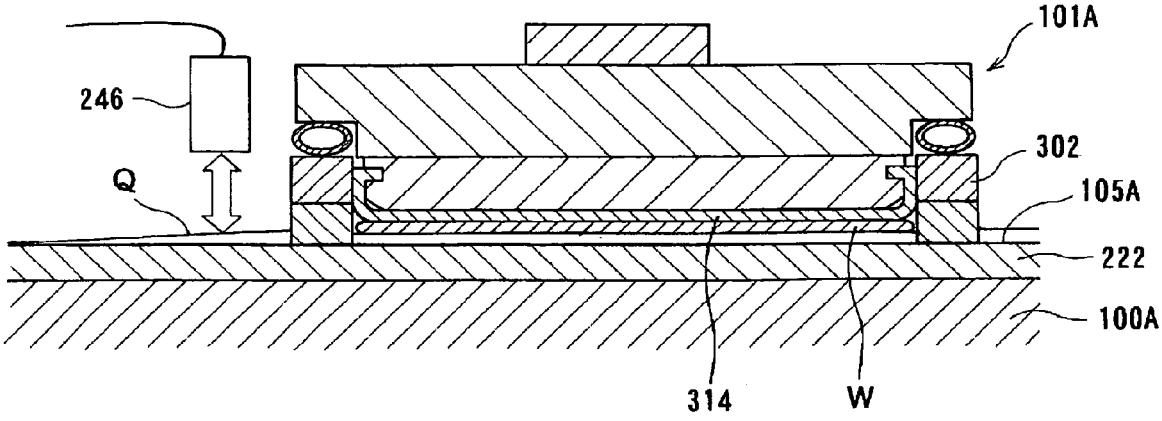
FIG. 17 is a vertical sectional diagram illustrating the thickness of the liquid film covering the polishing surface when the semiconductor wafer has detached from the polishing surface and attached to the lower surface of the top ring.

It is noted in this regard that the distribution of the liquid (liquid film) Q supplied to the polishing surface 105A and present on the polishing surface 105A differs between the case where the semiconductor wafer W is not yet attached to the lower surface of the top ring 101A and lies on the polishing surface 105A, as shown in FIG. 16, and the case where the semiconductor wafer W has detached from the polishing surface 105A and attached to the lower surface of the top ring 101A, as shown in FIG. 17. In particular, the liquid film Q lying downstream of the top ring 101A is thinner when the semiconductor wafer W is not yet attached to the lower surface of the top ring 101A and lies on the polishing surface 105A, as shown in FIG. 16, than when the semiconductor wafer W has detached from the polishing surface 105A and attached to the lower surface of the top ring 101A, as shown in FIG. 17. In view of this, a change in the thickness of the liquid (liquid film) Q, covering the polishing surface 105A in a film-like form, is detected at a point downstream of the top ring 101A by the liquid film thickness detection sensor 246 located lateral to the top ring 101A and, when the detected thickness of the liquid film Q has become larger than a predetermined thickness, the semiconductor wafer W is determined to have detached from the polishing surface 105A and attached to the top ring 101A.

Especially when the ring member 408 of the retainer ring 203 has a radial groove in its surface to be in contact with the polishing surface 105A, the liquid is supplied to the semiconductor wafer in a larger amount, which produces a larger difference in the thickness of the liquid film Q.

A load applied on the rotary motor of the turntable 100A changes before and after detachment of the semiconductor wafer W from the polishing surface 105A. Thus, it is also possible to lift up the top ring 101A on detection of the load difference.

In cases where it is not possible to detect detachment of the semiconductor wafer W from the polishing pad 222, the top ring 101A is to be lifted a predetermined time after starting attraction of the wafer. In order to prevent breakage of the semiconductor wafer or failure to pick up the wafer, which could occur if the top ring 101A is lifted at one stroke, it is preferred to lift up the semiconductor wafer W together with the top ring 101A while gradually or stepwise changing the height of the top ring 101A. It is also possible to gradually increase the force that lifts up the top ring 101A together with the semiconductor wafer W.

For the gradual lifting of the top ring 101A, it is preferred to use the vertically moving mechanism (lifting mechanism) 124 which utilizes the combination of the servomotor 138 and the ball screw 132 as in this embodiment. For the gradual increase of the force that lifts up the top ring 101A, it is preferred to use a lifting mechanism which uses a cylinder. When the vertically moving mechanism (lifting mechanism) 124, which utilizes the combination of the servomotor 138 and the ball screw 132, is used, the lifting force can be increased gradually by controlling the rotary torque of the servomotor 138. When an air cylinder is used, the lifting force can be increased gradually by controlling the pressure of a pressurized fluid to be supplied to the air cylinder.

It is also possible to detect detachment of the semiconductor wafer W from the polishing pad 222 by detecting the reaction force to the lifting force of the top ring 101A. In this case, a load cell for detecting the reaction force may be provided, e.g., in the top ring shaft 111 or the bridge 128.

In order to prevent failure to pick up the semiconductor wafer W, the pressure between the top ring 101A and the semiconductor wafer W before the start of the lifting operation for the top ring 101A in the lift-off operation is required to be a high vacuum of generally about −80±10 kPa. After the termination of polishing, the top ring 101A attracts the semiconductor wafer W when the top ring 101A is positioned at an appropriate height which ensures creation of the high attraction pressure between it and the semiconductor wafer W. This is because when the elastic membrane 314 has a hole, the pressure will leak if the top ring 101A lies too far away from the semiconductor wafer W. If the top ring 101A is too close to the semiconductor wafer W, on the other hand, the top ring 101A can come into contact with the semiconductor wafer W during polishing, causing breakage of the semiconductor wafer W or over-polishing of the wafer surface.

When lifting of the top ring 101A is started while the semiconductor wafer W is kept attached to the polishing surface 105A, a force that detaches the semiconductor wafer W from the polishing surface 105A is produced. When the top ring 101A is lifted at a high speed, the attraction force between the polishing surface 105A and the semiconductor wafer W will not sufficiently decrease during the initial period of lifting of the semiconductor wafer W. Accordingly, the semiconductor wafer W can be detached from the polishing surface 105 if the attraction force of the top ring 101A on the semiconductor wafer W is stronger than the attraction force between the polishing surface 105A and the semiconductor wafer W. However, the semiconductor wafer W will be broken if it cannot withstand the stress produced by the both attraction forces. On the contrary, if the attraction force between the polishing surface 105A and the semiconductor wafer W is stronger than the attraction force of the top ring 101A on the semiconductor wafer W, the latter attraction can be broken, resulting in failure to pick up the semiconductor wafer W. Such troubles are more likely to occur if the top ring 101A is lifted up at one stroke without waiting for detachment of the semiconductor wafer W from the polishing surface 105A by the attraction operation of the top ring 101A.

In view of this, the lifting of the top ring 101A may be carried out in a gradual manner or the lifting speed may be lowered, whereby the semiconductor wafer W can be stably lifted off the polishing surface 105A. Further, because the attraction force of the top ring 101A on the semiconductor wafer W is constant, the semiconductor wafer W can be lifted off securely by lifting the top ring 101A while controlling the lifting force in such a manner that the lifting force will not break the attraction of the top ring 101A on the semiconductor wafer W. For example, the semiconductor wafer W can be lifted off securely by lifting the top ring 101A while keeping the lifting force lower than the attraction force of the top ring 101A on the semiconductor wafer W.

On completion of the lifting of the top ring 101A, the top ring 101A is pivoted to move it to above the pusher 33, and the semiconductor wafer is transferred to the pusher 33. Thereafter, a cleaning liquid is sprayed upwardly, downwardly and laterally toward the top ring 101A to clean the wafer holding surface of the top ring 101A, the semiconductor wafer after polishing, and their surrounding area. The supply of the cleaning liquid may be continued to prevent drying of the top ring 101A during the period until the next semiconductor wafer is transferred to the top ring 101A. The cleaning liquid may be sprayed intermittently in view of the running cost. During polishing, polishing time, for example, may be divided into a plurality of steps and polishing conditions, such as the pressure of the top ring on the polishing pad, the rotational speeds of the top ring and the semiconductor wafer, the manner of holding the semiconductor wafer, etc. may be varied among the steps. The type, amount, concentration, temperature, timing of supply, etc. of the slurry used can also be varied.

In this embodiment, an amount or flow rate of a liquid, such as a slurry, to be supplied from the liquid supply nozzle 102A to the polishing surface 105A is decreased when the attraction force of the top ring 101A begins to act on the semiconductor wafer W in the lift-off operation for the semiconductor wafer W after polishing. It is also possible to stepwise decrease the flow rate of the liquid to be supplied from the liquid supply nozzle 102A to the polishing surface 105A to zero upon the start of the lift-off operation, i.e., when attracting the semiconductor wafer W to the top ring 101A to detach the semiconductor wafer W from the polishing surface 105A. This can decrease the amount of the liquid which serves to deform the semiconductor wafer into a sucker-like shape and securely eliminate the sucker-like deformation of the semiconductor wafer.

It is also possible to attract the semiconductor wafer W to the top ring 101A and detach the semiconductor wafer W from the polishing surface 105A while intermittently supplying the liquid to the polishing surface 105A, i.e., repeating supply of the liquid and stop of the supply at certain intervals, in the lift-off operation for the semiconductor wafer W after polishing. This can also decrease the amount of the liquid which serves to deform the semiconductor wafer into a sucker-like shape and securely eliminate the sucker-like deformation of the semiconductor wafer. The intermittent stop of the supply of liquid, unlike the gradual decrease of liquid supply to zero, can prevent drying of the polishing surface 105A, thereby preventing scratching in the semiconductor wafer W and the ring member 408 of the retainer ring 203.

It is also possible to allow a foaming liquid, such as carbonated water, to be present between the semiconductor wafer and the polishing surface, and foaming the liquid present between the semiconductor wafer and the polishing surface in the lift-off operation for the semiconductor wafer after polishing. This can also decrease the negative pressure produced between the semiconductor wafer and the polishing surface upon the lift-off operation.

It is also possible to attract the semiconductor wafer W to the top ring 101A and detach the semiconductor wafer W from the polishing surface 105A while moving the semiconductor wafer W and the polishing surface 105A of the turntable 100A at a decreased relative speed in the lift-off operation for the semiconductor wafer W after polishing.

Figure 18:
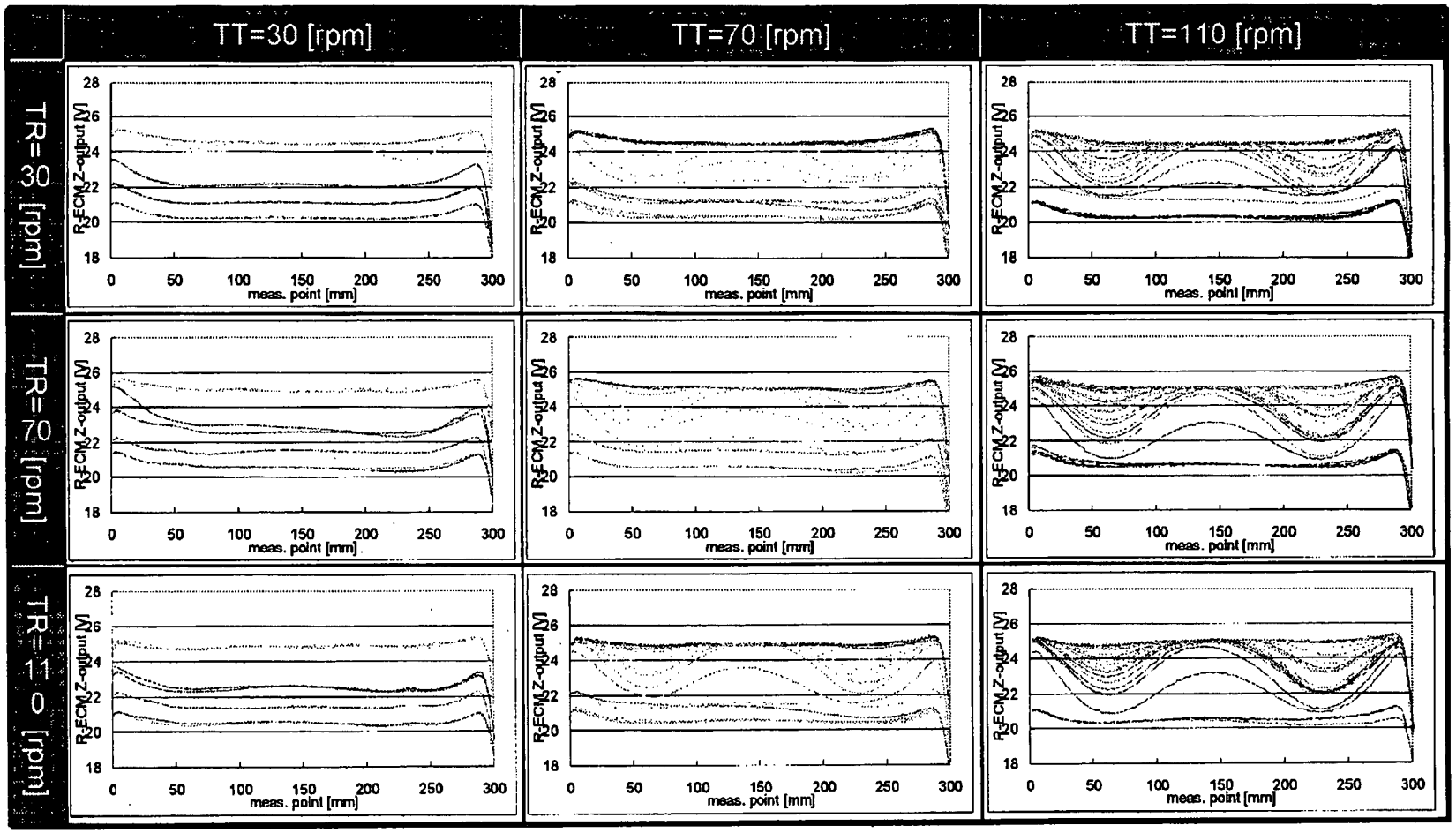
FIG. 18 shows graphs showing the deformation of a semiconductor wafer, time taken for the semiconductor wafer to detach from a polishing surface of a polishing pad, etc., as measured in wafer attracting operations carried out using varying rotational speeds of turntable (TT) and varying rotational speeds of top ring (TR)

FIG. 18 shows the deformation of a semiconductor wafer, time taken for the semiconductor wafer to detach from the polishing surface of a polishing pad, etc., as measured in wafer attracting operations carried out using varying rotational speeds of turntable (TT) and varying rotational speeds of top ring (TR). Taking as an example the graph in the case of TT (turntable)=30 (rpm) and TR (top ring)=30 (rpm), for example, the graph shows the deformation of the semiconductor wafer along the radial direction of the wafer. The number of the lines on the graph corresponds to the number of scans of the below-described eddy current sensor 248 shown in FIGS. 19 and 20 (number of times the sensor passed across the semiconductor wafer W). The ordinate of the graph represents the output value of the eddy current sensor. A smaller ordinate value indicates that the semiconductor wafer is nearer to the top ring and farther away from the eddy current sensor, while a larger ordinate value indicates that the semiconductor wafer is nearer to the polishing surface. Thus, the five lines in the graph indicates that the semiconductor wafer was scanned five times, and the way in which the output of the eddy current sensor (the ordinate value) decreases shows how the semiconductor wafer detaches from the polishing surface. Turning now to the graph in the case of TT (turntable)=110 (rpm) and TR (top ring)=30 (rpm), the graph shows that a large M-shaped deformation of the semiconductor wafer (surface to be processed facing downward) occurred and the deformation gradually disappeared during the semiconductor wafer attracting operation. The point in time at which the semiconductor wafer detaches from the polishing pad can also be detected by monitoring the semiconductor wafer with the eddy current sensor in this manner.

The results of this experiment demonstrate that a decrease in the relative speed between a turntable and a semiconductor wafer will decrease the negative pressure produced between the semiconductor wafer and the polishing surface. Specifically, when the center of the semiconductor wafer lies at a distance of 195 mm from the center of the turntable (as set in this experiment), the deformation of the semiconductor wafer will be small and therefore the semiconductor wafer will be more easily detached from the polishing surface if the rotational speed of the turntable is decreased to 30 rpm or lower, i.e., if the relative speed at the center point of the semiconductor wafer is decreased to 613 mm/sec or lower.

Thus, by decreasing the relative speed between a semiconductor wafer and a polishing surface when attracting the semiconductor wafer to a top ring and detaching the semiconductor wafer from the polishing surface in a lift-off operation for the semiconductor wafer, it becomes possible to easily and quickly detach the semiconductor wafer from the polishing surface and attach the semiconductor wafer to the lower surface of the top ring while reducing the deformation of the semiconductor wafer.

When serial processing of a semiconductor wafer is performed using the above-described polishing system shown in FIGS. 3 and 4, the semiconductor wafer is transferred on the following route: the wafer cassette of the front loading portion 20→the first transfer robot 22→the reversing machine 31→the lifter 32→the first transfer stage TS1 of the first linear transporter 5→the pusher 33→the top ring 101A→the turntable 100A→the pusher 33→the second transfer stage TS2 of the first linear transporter 5→the pusher 34→the top ring 101B→the turntable 100B→the pusher 34→the third transfer stage TS3 of the first linear transporter 5→the lifter 35→the second transfer robot 40→the lifter 36→the fifth transfer stage TS5 of the second linear transporter 6→the pusher 37→the top ring 101C→the turntable 100C→the pusher 37→the sixth transfer stage TS6 of the second linear transporter 6→the pusher 38→the top ring 101D→the turntable 100D→the pusher 38→the seventh transfer stage TS7 of the second linear transporter 6→the lifter 36→the second transfer robot 40→the reversing machine 41→the primary cleaning device 42→the secondary cleaning device 43→the tertiary cleaning device 44→the quaternary cleaning device 45→the first transfer robot 22→the wafer cassette of the front loading portion 20.

When parallel processing of a semiconductor wafer is performed, the semiconductor wafer is transferred on the following route: the wafer cassette of the front loading portion 20→the first transfer robot 22→the reversing machine 31→the lifter 32→the first transfer stage TS1 of the first linear transporter 5→the pusher 33→the top ring 101A→the turntable 100A→the pusher 33→the second transfer stage TS2 of the first linear transporter 5→the pusher 34→the top ring 101B→the turntable 100B→the pusher 34→the third transfer stage TS3 of the first linear transporter 5→the lifter 35→the second transfer robot 40→the reversing machine 41→the primary cleaning device 42→the secondary cleaning device 43→the tertiary cleaning device 44→the quaternary cleaning device 45→the first transfer robot 22→the wafer cassette of the front loading portion 20.

Another semiconductor wafer is transferred on the following route: the wafer cassette of the front loading portion 20→the first transfer robot 22→the reversing machine 31→the lifter 32→the fourth transfer stage TS4 of the first linear transporter 5→the lifter 35→the second transfer robot 40→the lifter 36→the fifth transfer stage TS5 of the second linear transporter 6→pusher 37→the top ring 101C→the turntable 100C→the pusher 37→the sixth transfer stage TS6 of the second linear transporter 6→the pusher 38→the top ring 101D→the turntable 100D→the pusher 38→the seventh transfer stage TS7 of the second linear transporter 6→the lifter 36→the second transfer robot 40→the reversing machine 41→the primary cleaning device 42→the secondary cleaning device 43→the tertiary cleaning device 44→the quaternary cleaning device 45→the first transfer robot 22→the wafer cassette of the front loading portion 20.

Figure 19:
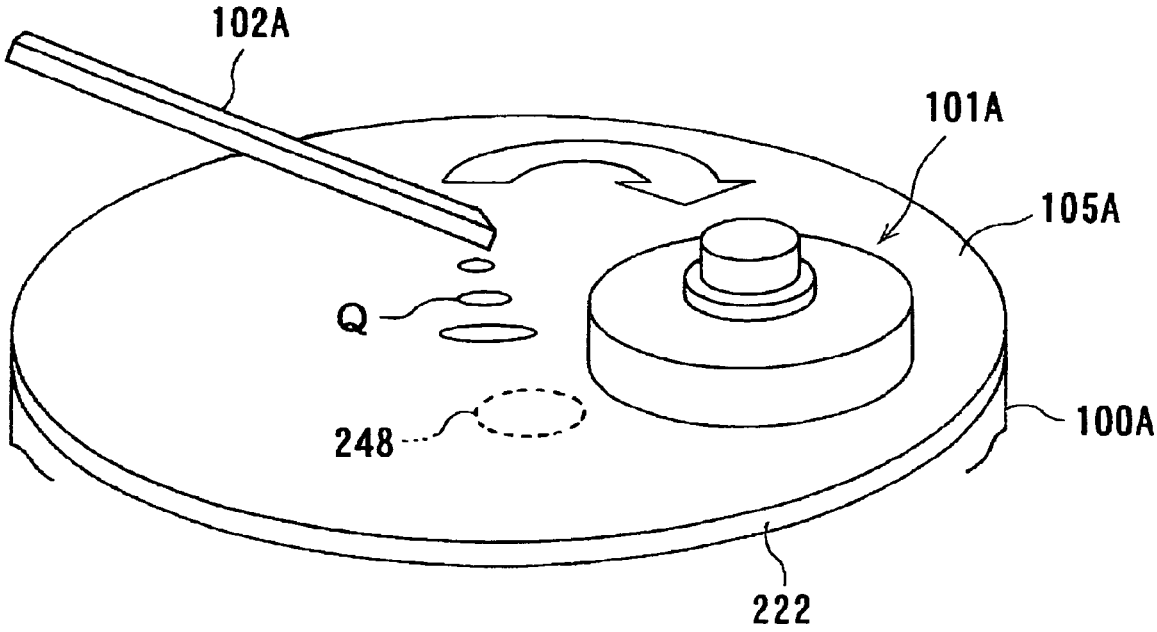
FIG. 19 is a schematic perspective view of the main portion of a polishing apparatus according to another embodiment of the present invention.
Figure 20:
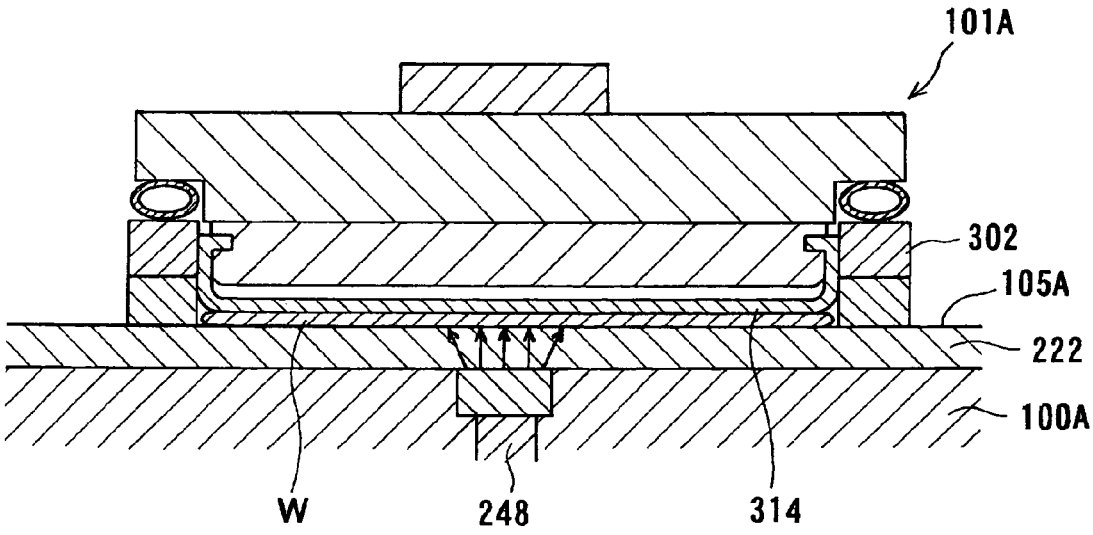
FIG. 20 is a schematic vertical sectional view of the main portion of the polishing apparatus shown in FIG. 19.

FIGS. 19 and 20 show a polishing apparatus according to another embodiment of the present invention. This polishing apparatus differs from the polishing apparatus of the preceding embodiment in that instead of the liquid film thickness detection sensor 246 used in the polishing apparatus of the preceding embodiment, an eddy current sensor 248 as a distance measuring sensor, directed to the semiconductor wafer W held by the top ring 101A, is embedded in the turntable 100A. A distance between the semiconductor wafer W and the polishing surface 105A is detected with the eddy current sensor 248 in order to confirm or determine whether the semiconductor wafer W has detached from the polishing surface 105A and attached to the top ring 101A.

When the semiconductor wafer W begins to be attracted to the lower surface of the top ring 101A, that portion of the semiconductor wafer W which corresponds to the attraction portion of the top ring 101A becomes raised, while the other portion of the semiconductor wafer W is drawn downward (i.e., in the opposite direction from the lifting direction of the top ring 101A) by the attraction force produced between the polishing surface 105A and the semiconductor wafer W. Thus, when the eddy current sensor 248 is fixed under the polishing surface 105A, that portion of the semiconductor wafer W which corresponds to the attraction portion of the top ring 101A moves apart from the eddy current sensor 248 whereby the electromagnetic field, encircling the eddy current sensor 248 and that portion of the semiconductor wafer W, gradually becomes weak and the signal value decreases. On the other hand, the edge portion of the semiconductor wafer W, on which the attraction force, i.e., the force that draws the semiconductor wafer downward, between the polishing surface 105A of the polishing pad 222 and the semiconductor wafer W strongly acts, little moves away from the polishing surface 105A. Accordingly, the signal value little decreases. By utilizing the difference in the signal value, it becomes possible to confirm or determine the distribution of distances between the semiconductor wafer W and the polishing surface 105A and thus the overall shape of the semiconductor wafer W.

The above-described data shown in FIG. 18, in particular the data on the deformation of a semiconductor wafer and time taken for the semiconductor wafer to detach from the polishing surface of a polishing pad, was measured with the eddy current sensor 248 while varying rotational speeds of turntable and rotational speeds of top ring.

It thus becomes possible with the eddy current sensor 248 provided in the turntable 100A to confirm or determine the distribution of vertical positions of an entire semiconductor wafer W with respect to the polishing surface 105A. Such data can be used as a trigger for lifting of the top ring 101A. Furthermore, the deformation of the semiconductor wafer W can also be determined. Accordingly, when a deformation of the semiconductor wafer, which would apply a heavy load on the semiconductor wafer W, is detected, the attraction on the semiconductor wafer W can be stopped to prevent breakage of the semiconductor wafer W. In one example, the operation of stop of the attracting the semiconductor wafer W can be attained by stopping a supply of vacuum to the semiconductor wafer W.

A confirmation as to whether the semiconductor wafer has detached from the polishing surface and attached to the top ring may also be made based on a decrease in electric current value in a motor that drives the polishing surface or in a motor that drives the top ring.

When the semiconductor wafer, which is not yet detached from and lies on the polishing surface, is moved relative to the polishing surface, a friction force is produced between them, whereby a load is applied on a motor that drives the polishing surface or the top ring. The load can be monitored as a motor current value. It is therefore possible to set a threshold value of motor current value and use it as a trigger for lifting of the top ring.

A confirmation as to whether the semiconductor wafer has detached from the polishing surface and attached to the top ring may also be made based on a change in a force that draws the top ring downward.

While the present invention has been described with reference to the embodiments thereof, it will be understood by those skilled in the art that the present invention is not limited to the particular embodiments described above, but it is intended to cover modifications within the inventive concept.

What is claimed is:

1. A polishing method for polishing a workpiece, the polishing method comprising:

carrying out processing of a surface to be polished of a workpiece by supplying a liquid to a polishing surface of a turntable and pressing the surface to be polished of the workpiece held by a holding device against the polishing surface while moving the workpiece and the polishing surface relative to each other at a first relative speed;

attracting the workpiece after the processing to the holding device while moving the workpiece and the polishing surface at a second relative speed, which is lower than the first relative speed, thereby detaching the workpiece from the polishing surface; and lifting up the holding device together with the workpiece.

2. The polishing method according to claim 1, wherein the turntable having the polishing surface is being rotated during polishing of the workpiece, and a rotational speed of the turntable is decreased to 30 rpm or lower, or a relative speed at a center point of the workpiece is decreased to 613 mm/sec or lower in the step of attracting the workpiece.

3. The polishing method according to claim 1, wherein the step of attracting the workpiece comprises applying a vacuum to the workpiece thereby attracting the workpiece, a degree of vacuum in the applying of the vacuum being stepwise increased until the workpiece detaches from the polishing surface.

4. The polishing method according to claim 1, wherein detachment of the workpiece from the polishing surface and attachment of the workpiece to the holding device is confirmed based on a decrease in electric current in a motor that drives the turntable having the polishing surface or a decrease in electric current in a motor that drives the holding device.

5. The polishing method according to claim 1, wherein detachment of the workpiece from the polishing surface and attachment of the workpiece to the holding device is confirmed by detecting a change in a thickness of a liquid film covering the polishing surface.

6. The polishing method according to claim 1, wherein detachment of the workpiece from the polishing surface and attachment of the workpiece to the holding device is confirmed based on a change in a force that draws the holding device downward.

7. The polishing method according to claim 1, wherein detachment of the workpiece from the polishing surface and attachment of the workpiece to the holding device is confirmed by detecting a distance between the workpiece and the polishing surface.

8. The polishing method according to claim 7, wherein the distance between the workpiece and the polishing surface is detected with an eddy current sensor.

9. The polishing method according to claim 1, wherein the workpiece is lifted up together with the holding device while stepwise changing the height of the holding device.

10. The polishing method according to claim 1, wherein a force to lift up the holding device together with the workpiece is stepwise changed.

* * * * *